US010202790B2

(12) United States Patent
Fiedler

(10) Patent No.: US 10,202,790 B2
(45) Date of Patent: Feb. 12, 2019

(54) CLOSURE DEVICE FOR CONNECTING TWO PARTS

(71) Applicant: Fidlock GmbH, Hannover (DE)

(72) Inventor: Joachim Fiedler, Hannover (DE)

(73) Assignee: Fidlock GmbH, Hannover (DE)

( * ) Notice: Subject to any disclaimer, the term of this patent is extended or adjusted under 35 U.S.C. 154(b) by 437 days.

(21) Appl. No.: 14/649,656

(22) PCT Filed: Dec. 4, 2013

(86) PCT No.: PCT/EP2013/075552
§ 371 (c)(1),
(2) Date: Sep. 28, 2015

(87) PCT Pub. No.: WO2014/086874
PCT Pub. Date: Jun. 12, 2014

(65) Prior Publication Data

US 2016/0010371 A1 Jan. 14, 2016

(30) Foreign Application Priority Data

Dec. 5, 2012 (DE) ..... 10 2012 222 344

(51) Int. Cl.
*E05C 19/16* (2006.01)
*E05C 19/02* (2006.01)

(52) U.S. Cl.
CPC ..... *E05C 19/16* (2013.01); *E05C 19/02* (2013.01); *Y10T 292/11* (2015.04)

(58) Field of Classification Search
CPC ..... A45C 13/1069; A45C 13/1084; A45C 13/1092; A45C 13/123; A45C 13/126; Y10T 24/32; Y10T 292/096; Y10T 292/0969; Y10T 70/7486; Y10T 70/7407; Y10T 292/11; E05B 13/103; E05B 13/105; E05B 37/16; E05B 47/0038;
(Continued)

(56) References Cited

U.S. PATENT DOCUMENTS 4,831,694 A * 5/1989 Kong ..... A44B 11/266 24/606
6,041,721 A * 3/2000 Weston ..... E05C 19/14 108/64
(Continued)

FOREIGN PATENT DOCUMENTS

DE 202005006516 U1 8/2006
DE 102009060119 A1 6/2011
(Continued)

*Primary Examiner* — Christine M Mills
(74) *Attorney, Agent, or Firm* — The Webb Law Firm

(57) ABSTRACT

A closure device for connecting two parts includes a first closure part, a second closure part which for closing the closure device is attachable to the first closure part in a closing direction, is held at the first closure part in a closed position, for opening the closure device is movable relative to the first closure part in an opening direction different from the closing direction, and after opening of the closure device is removable from the first closure part against the closing direction for separating the closure parts, and magnetic means which act between the first closure part and the second closure part, in order to support the closing of the closure device by providing a force of magnetic attraction.

13 Claims, 23 Drawing Sheets

(58) Field of Classification Search
CPC ..... E05B 47/004; E05B 65/52; E05B 37/12; A44B 1/34; A44B 1/38; A44B 11/258; A44B 11/2584; A44B 11/263; A44B 17/0023; A44B 17/0041; A44B 11/2592; A44D 2203/00; E05C 19/16; E05C 19/02
USPC ..... 24/303; 292/1, 251.5, DIG. 37
See application file for complete search history.

(56) References Cited

U.S. PATENT DOCUMENTS

| | | | | |
|---|---|---|---|---|
| 2002/0149208 | A1* | 10/2002 | Zamberg | E05C 19/10 292/98 |
| 2007/0138806 | A1 | 6/2007 | Ligtenberg et al. | |
| 2010/0283269 | A1 | 11/2010 | Fiedler | |
| 2010/0287741 | A1 | 11/2010 | Fiedler | |
| 2011/0167595 | A1 | 7/2011 | Fiedler | |
| 2012/0222356 | A1 | 9/2012 | Beck | |

FOREIGN PATENT DOCUMENTS

| | | | | |
|---|---|---|---|---|
| WO | 2008006354 | A2 | 1/2008 | |
| WO | 2008006357 | A2 | 1/2008 | |
| WO | WO-2008006355 | A2 * | 1/2008 | A44B 11/2511 |
| WO | 2009006888 | A2 | 1/2009 | |

* cited by examiner

CLOSURE DEVICE FOR CONNECTING TWO PARTS

CROSS-REFERENCE TO RELATED APPLICATIONS

This application is the United States national phase of International Application No. PCT/EP2013/075552 filed Dec. 4, 2013, and claims priority to German Patent Application No. 10 2012 222 344.4 filed Dec. 5, 2012, the disclosures of which are hereby incorporated in their entirety by reference.

BACKGROUND OF THE INVENTION

Field of the Invention

This invention relates to a closure device for connecting two parts.

Description of Related Art

Such closure device comprises a first closure part and a second closure part. For closing the closure device, the second closure part is attachable to the first closure part in a closing direction, is held at the first closure part in a closed position, for opening the closure device is movable relative to the first closure part in an opening direction different from the closing direction, and after opening of the closure device is removable from the first closure part against the closing direction for separating the closure parts.

By the fact that the opening direction is different from the closing direction it is to be understood here that the opening direction points in a direction other than the closing direction and in particular neither is directed opposite to the closing direction. The opening direction thus includes an angle different from 0° and 180° to the closing direction.

In addition, magnetic means are provided, which act between the first closure part and the second closure part, in order to support closing of the closure device by providing a force of magnetic attraction.

Such closure device for example is known from WO 2008/006357 A2.

In such closure device, closing, opening and separating of the closure parts is effected in the manner of a circulating movement. For closing, the closure parts are attached to each other in a closing direction. For opening, the closure parts are moved relative to each other along an opening direction different from the closing direction, for example directed transversely to the closing direction, so that a hold between the closure parts is eliminated. After opening, the closure parts then can be separated from each other by being removed from each other against the closing direction. For closing again, the closure parts then can again be attached to each other in the closing direction.

The individual actuating phases here are referred to as "closing" (corresponding to attaching the second closure part to the first closure part for closing the closure device), "opening" (corresponding to opening the closure device by moving the second closure part in the opening direction relative to the first closure part), and "separating" (corresponding to the movement of the second closure part against the closing direction relative to the first closure part for removing the closure parts from each other).

In such closure device it can occur that after opening of the closure device and after a (small) separation path of the closure parts a return movement of the closure parts relative to each other, i.e. a movement of the second closure part against the opening direction relative to the first closure part, occurs and due to the magnetic means the closure parts again are automatically drawn into the closed position, so that the closure device immediately closes again. This can be unpleasant for a user, and the closure device possibly can be difficult to actuate, because after opening the closure device possibly snaps shut again inadvertently, so that the closure device again must be opened.

SUMMARY OF THE INVENTION

It is an object of the present invention to provide a closure device in which opening can be effected in a haptically pleasant way and in particular snapping shut immediately after opening is not easily possible.

This object is solved by a subject-matter with the features as described herein.

Accordingly, blocking means are provided in the closure device, which are formed to block a movement of the second closure part back against the opening direction relative to the first closure part on separation of the closure parts.

The present invention proceeds from the idea that during separation of the closure parts from each other care must be taken that a return movement of the closure parts relative to each other, i.e. a movement of the second closure part back against the opening direction relative to the first closure part cannot be effected easily and immediately. Due to the fact that such return movement at least sectionally is blocked during separation of the closure parts from each other, the second closure part cannot directly get into a position relative to the first closure part, in which the second closure part again is drawn towards the first closure part in the closing direction. By means of the blocking means, snapping shut of the closure device directly after opening during separation of the closure parts from each other thus is prevented, so that the closure parts can safely be removed from each other and at least can be separated from each other along a predetermined path.

In the closure device it can be provided that on opening of the closure device the force of magnetic attraction at least is attenuated. The magnetic means—for example a magnet on the one closure part and a magnetic armature of a ferromagnetic material on the other closure part or a magnet each on the one and on the other closure part—effect a force of magnetic attraction between the closure parts, when the closure parts face each other in a position suitable for closing. The magnetic means advantageously are dimensioned such that closing of the closure device largely is effected automatically, so that a user only has to bring the closure parts into a suitable positional relation to each other and closing then proceeds largely automatically by action of the magnetic means.

In the closed position the magnetic means face each other in a magnetically attracting manner and are approached to each other, so that the force of magnetic attraction is comparatively large. For opening, the magnetic means on the first closure part on the one hand and on the second closure part on the other hand then are removed from each other, for example sheared off each other by a tangential shifting or twisting movement, so that the force of magnetic attraction of the magnetic means is attenuated.

For example, when two magnets are arranged on each closure part, which with different poles each point to the magnet on the other closure part, a reversal of the magnetic force also can be effected on opening, in that the magnets repel each other after opening. While in the closed position the magnets of the closure parts point towards each other in pairs with unlike poles, like poles of the magnets are approached to each other on opening, so that the magnets have a magnetically repelling effect and thus magnetically support the separation of the closure parts after opening.

Advantageously, there are provided means which are formed to magnetically or by a spring mechanism support the separation of the closure parts after opening of the closure device. These means can be realized by the magnetic means themselves, in that—as described above—the magnetic means have a magnetically repelling effect after opening and thus magnetically support the separation of the closure parts. Alternatively or in addition, however, there can also be provided mechanical means, for example a mechanical spring, which on closing and/or opening are pretensioned mechanically and after opening then effect a force of ejection against the closing direction for separating the closure parts from each other in a mechanically assisted way.

Furthermore, there can be provided means which effect a return movement of the closure parts against the opening direction into a position in which the second closure part can be attached to the first closure part in the closing direction for closing the closure device, after the second closure part has been moved against the closing direction relative to the first closure part along a predetermined path for separating the closure parts. When the closure parts have been separated from each other by being removed from each other against the closing direction along the predetermined path, the resetting means acting for example magnetically or by a spring mechanism effect a return movement of the closure parts relative to each other, so that the closure parts again get into a starting position in which the second closure part can be attached to the first closure part in the closing direction, in order to close the closure device. The resetting means for example can be realized by the magnetic means of the closure parts themselves, which effect that in the case of a renewed attachment of the second closure part to the first closure part, the closure parts get into a position relative to each other in which closing of the closure device is possible.

In an advantageous aspect, the first closure part and the second closure part are mechanically latched with each other in the closed position. Due to being latched mechanically, the second closure part cannot be moved from the closed position relative to the first closure part against the closing direction. Due to being latched mechanically, the two closure parts thus are held at each other in the closed position, so that when a force acts against the closing direction, the closure device produces a safe, reliable, highly loadable connection between the closure parts. The mechanical latching can be released by moving the second closure part in the opening direction relative to the first closure part, in that the mechanically latched parts are moved relative to each other in the opening direction, for example transversely to the closing direction, so that the second closure part gets out of engagement with the first closure part.

For realizing the mechanical latching, one of the closure parts for example can include a detent spring element and the other one of the closure parts can include at least one latching protrusion. In the closed position, the detent spring element and the at least one latching protrusion mechanically are in latching engagement with each other, so that a movement of the second closure part against the closed position relative to the first closure part is blocked. For opening, the second closure part then can be shifted or twisted relative to the first closure part, so that the latching protrusion slides out of engagement with the detent spring element and the mechanical latching thus is eliminated.

The blocking means for example can be formed by a connecting link guideway for at least sectionally guiding the second closure part on opening of the closure device and/or on separation of the closure parts. The connecting link guideway includes at least one abutment portion which on separation of the closure parts blocks a movement of the second closure part back against the opening direction relative to the first closure part. The connecting link guideway is arranged on one of the closure parts and is in engagement e.g. with a pin or another suitable form-fit element on the other one of the closure parts. Due to the engagement, the closure parts are guided relative to each other on opening and/or on separation, wherein on separation the pin or the form-fit element is in contact with the abutment portion and in this way prevents a movement of the second closure part back against the opening direction.

In a concrete aspect, the connecting link guideway includes a first connecting link guide portion for guiding the second closure part relative to the first closure part in the closing direction on closing and a second connecting link guide portion for guiding the second closure part relative to the first closure part in the opening direction on opening. Furthermore, a third connecting link guide portion can be provided, which guides the second closure part relative to the first closure part against the closing direction on separation (after opening the closure device). The connecting link guideway thus determines the movement of the second closure part relative to the first closure part on closing, on opening and possibly also on separation, and thus describes the circulating movement which the second closure part performs relative to the first closure part first on closing, then on opening and finally on separation.

Alternatively or in addition, the blocking means also can be formed by a latching guide which on opening produces a mechanical latching connection of the closure parts for blocking a movement of the second closure part back against the opening direction relative to the first closure part. On opening, the latching guide on the one of the closure parts for example gets in engagement with a latching hook on the other one of the closure parts, wherein the engagement is such that the second closure part cannot be moved back against the opening direction.

The latching guide at the same time provides a guidance against the closing direction for separating the closure parts from each other, so that after opening the closure parts can be separated from each other in a guided way and thus can be removed from each other. The latching guide here provides a guidance against the closing direction along a predetermined path. After the predetermined separation path, the closure parts can again be moved freely relative to each other and thus also be brought into a position relative to each other in which they can again be attached to each other, in order to close the closure device.

In an advantageous aspect, the second closure part is connected with an actuating element and guided on the actuating element such that for opening the closure device the actuating element is to be moved relative to the second closure part in an actuating direction different from the opening direction and the movement of the actuating element is converted into a movement of the second closure part in the opening direction. This proceeds from the idea to provide an actuating element on which the second closure part is forcibly guided. By means of the actuating element the second closure part here can be moved in the opening direction, wherein the actuating movement of the actuating element is different from the movement of the second closure part on opening. For actuating, the actuating element thus is to be moved in an actuating direction different from the opening direction, and due to the forced guidance the actuating movement is converted into a movement of the second closure part in the opening direction.

By the fact that the actuating direction should be different from the opening direction it is to be understood here that the actuating direction and the opening direction are not equidirectional to each other, i.e. describe an angle different from 0 degrees relative to each other. In particular, the actuating direction—other than the opening direction with respect to the closing direction—also can be directed opposite to the opening direction.

For example, the actuating direction can be equidirectional or opposite to the closing direction, so that for opening the closure device the actuating element is to be moved in or opposite to the closing direction relative to the second closure part.

Such actuating element advantageously can be employed for example when using the closure device on a piece of furniture, for example on a drawer, a sliding door or a swing door. The actuating element for example can integrally be connected with a drawer, wherein by pressing on the drawer (in the closing direction) a movement of the second closure part is effected in the opening direction (for example transversely to the closing direction), so that by pressing on the drawer the closure device can be released.

The same can happen with a sliding door. The actuating element for example is formed integrally with the sliding door, so that by movement of the sliding door in the closing direction the second closure part is moved in the opening direction (for example transversely to the closing direction).

The second closure part for example can be forcibly guided on the actuating element via a guiding device such that during a movement of the actuating element in the actuating direction the second closure part is moved in the opening direction relative to the first closure part. By means of the guiding device, the movement of the actuating element in the actuating direction thus is converted into a movement of the second closure part in the opening direction, wherein the guiding device for example can be formed as oblique guide with at least one oblique guideway or as threaded guide with at least one thread groove. An oblique guide in particular can be used when for opening the second closure part is to be shifted linearly (straight) relative to the first closure part. A threaded guide for example can be used when for opening the second closure part is to be moved by rotating relative to the first closure part.

In principle, however, other configurations of a forced guidance or forced coupling also are possible, for example a transmission by using gearwheels, a cable guide by using a suitable cable drive, a parallelogram guide or a swivel guide by using a lever mechanism.

Between the actuating element and the second closure part damping means can be provided in an advantageous development, which are formed to attenuate a power transmission from the actuating element to the second closure part, when the actuating element is moved in the actuating direction. A power transmission thus is not directly effected in a rigid way, but in a damped way via the damping means which for example can be designed in that between the actuating element and the second closure part elastically resilient (damping) elements are arranged. By means of the damping means it can be prevented, for example, that in the case of a shock or another action of force on the actuating element, which is not connected with a deliberate actuation, no undesired opening is effected.

The damping means for example can be formed as pneumatic or hydraulic damper, which in the case of an impulse-like load dampingly acts between the actuating element and the second closure part and blocks or at least retards an impulse-like action of force. It can thereby be ensured that e.g. in use on a sliding door in a vehicle an actuation of the closure device cannot be effected during braking of the vehicle or during a crash or another impulse-like load.

The idea to guide the second closure part on an actuating element, in order to effect opening of the closure device by actuating the actuating element also represents an idea of its own which also can be employed independent of the blocking means. A closure device for connecting two parts of this kind comprises

- a first closure part,
- a second closure part, which for closing the closure device is attachable to the first closure part in a closing direction, is held at the first closure part in a closed position, for opening the closure device is movable relative to the first closure part in an opening direction different from the closing direction, and after opening of the closure device is removable from the first closure part against the closing direction for separating the closure parts, and
- magnetic means, which act between the first closure part and the second closure part, in order to support closing of the closure device by providing a force of magnetic attraction.

It is provided that the second closure part is connected with an actuating element and guided on the actuating element such that for opening the closure device the actuating element is to be moved relative to the second closure part in an actuating direction different from the opening direction and the movement of the actuating element is converted into a movement of the second closure part in the opening direction.

The advantages and advantageous aspects described above also are applied analogously to this closure device, wherein the features of the sub-claims explained above also can be employed in combination with this closure device.

In particular, the closure device also can include blocking means which are formed to block a movement of the second closure part back against the opening direction relative to the first closure part on separation of the closure parts.

A closure device as described above can be used in particular on furniture elements, for example sliding door units or drawer units. Correspondingly, a furniture element, in particular a sliding door unit or a drawer unit, advantageously can comprise a closure device as described above.

BRIEF DESCRIPTION OF THE DRAWINGS

The idea underlying the invention will be explained in detail below with reference to the exemplary embodiments illustrated in the Figures, in which.

DETAILED DESCRIPTION OF THE INVENTION

Figure 1:
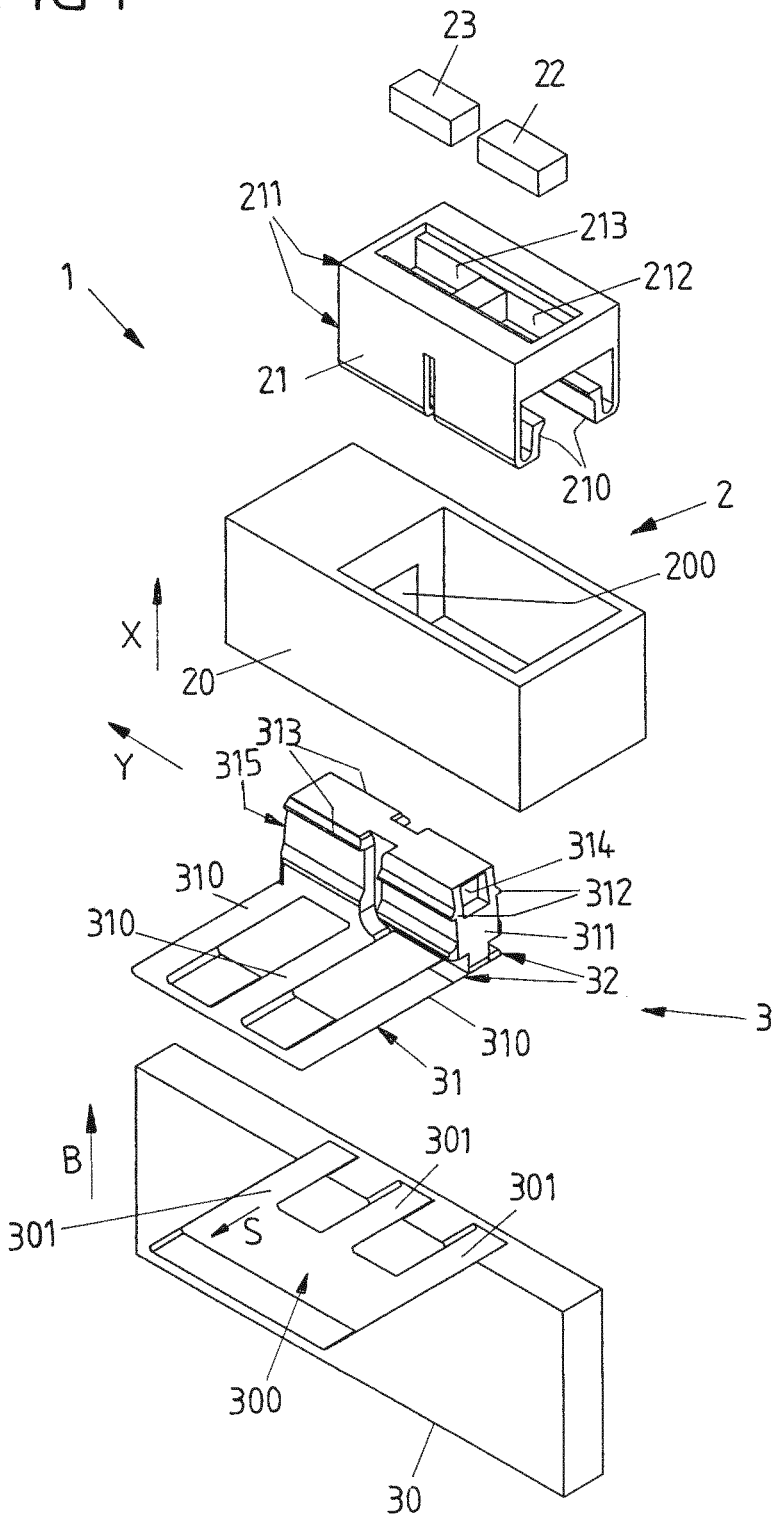
FIG. 1 shows an exploded view of a first exemplary embodiment of a closure device.

FIG. 1 as well as FIGS. 2A to 2E show a first exemplary embodiment of a closure device 1, in which a first closure part 2 (female part) can latchingly be brought in engagement with a second closure part 3 (male part), in order to produce a mechanically firm, loadable connection between the closure parts 2, 3 in a closed position.

The first closure part 2 includes a housing 20 as well as a detent spring element 21 arranged in a receiving opening 200 of the housing 20. On receiving openings 212, 213 of the detent spring element 21 magnets 22, 23 are arranged, which with different poles point towards the second closure part 3. The detent spring element 21 furthermore includes two pairs of detent spring arms 210, 211 axially offset to each other along an opening direction Y, which also are different in their height along a closing direction X, as can be taken e.g. from FIG. 2A.

The second closure part 3 includes a plug 311 on which two pairs of latching protrusions 312, 313 are arranged, which each are associated to a pair of detent spring arms 210, 211 of the detent spring element 21. The pairs of latching protrusions 312, 313 are offset to each other along the closing direction X, corresponding to the offset in the height of the detent spring arms 210, 211, so that the pair of latching protrusions 312 is arranged below the pair of latching protrusions 313 along the closing direction X.

Via a guiding part 31, the second closure part 3 is guided on a guiding device 300 of an actuating element 30. The guiding part 31 rests in the guideway 301 of the guiding device 300 with webs 310 and via the guideway 301 is guided on the actuating element 30 along an oblique guiding direction S.

Figure 2A:
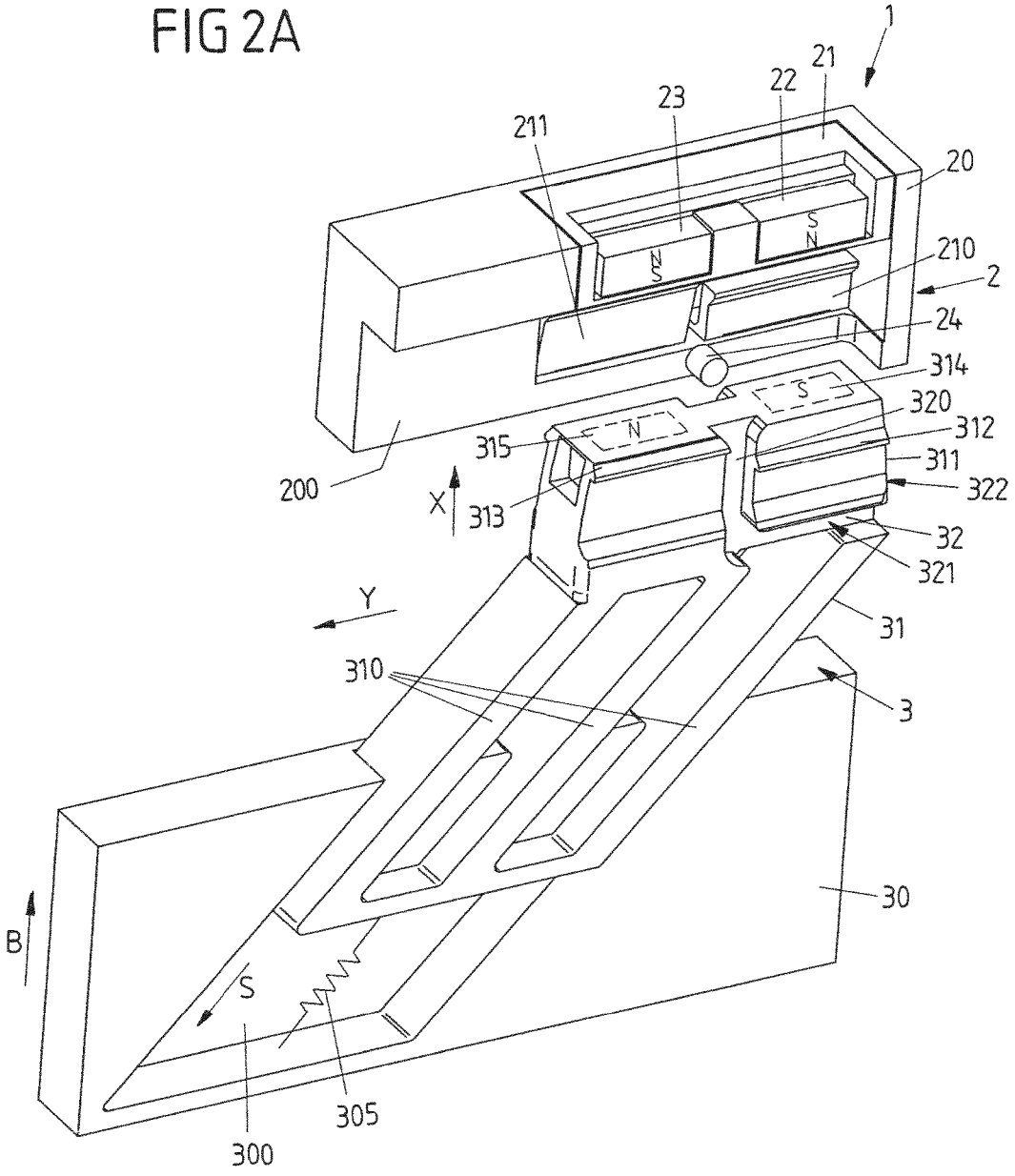
FIG. 2A shows a view of the closure device before closing.

As shown in FIG. 2A, a connecting link guideway 32 is formed on the plug 311, which includes a first connecting link portion 320 and a second connecting link portion 321 as well as an abutment portion 322. The first connecting link portion 320 substantially extends along the closing direction X, while the second connecting link portion 321 extends along the opening direction Y. The abutment portion 322, on the other hand, corresponds to a rear end face of the plug 311.

In general, the plug 311 includes two connecting link guideways 32 which extend on both sides of the plug 311, namely on different sides of the plug 311, based on a plane defined by the closing direction X and the opening direction Y.

The closure device 1 serves for releasably connecting two parts with each other. For example, the closure device 1 can be part of a piece of furniture and serve for locking a sliding door, a drawer, a cupboard door or the like. One of the closure parts 2, 3, for example the first closure part 2, is mounted on a furniture body, while the other one of the closure parts 2, 3, for example the second closure part 3, is mounted on the element to be shifted, for example on the sliding door or the drawer. In a closed position, in which the first closure part 2 and the second closure part 3 latchingly are in engagement with each other, the element to be shifted, for example the drawer or the sliding door, is held in a locking way by means of the closure device 1. For opening the element to be shifted, for example the drawer or the sliding door, the closure device 1 then can be opened, i.e. unlocked, in order to separate the closure parts 2, 3 from each other and to open the element to be shifted.

The mode of operation of the closure device can be taken from the views according to FIGS. 2A to 2E.

FIG. 2A first of all shows the closure device 1 in a state before closing, in which the closure parts 2, 3 are present separate from each other. The first closure part 2 (female part) and the actuating element 30 each are shown here in a partial sectional view, in order to clear the view into the inner receiving opening 200 of the housing 20 and of the guiding device 300.

For closing, the second closure part 3 is attached to the first closure part 2 in the closing direction X (what is decisive here is the relative movement; it is irrelevant whether the first closure part 2 is fixed and the second closure part 3 is movable or vice versa the second closure part 3 is fixed and the first closure part 2 is movable). The second closure part 3 is inserted into the receiving opening 200, wherein an inwardly protruding pin 24 immerses into an associated connecting link guideway 32 of the plug 311 and initially gets into the first connecting link portion 320 of the connecting link guideway 32 (the receiving opening 200 includes two opposed pins 24, wherein one pin 24 is associated to each connecting link guideway 32; only one pin 24 each is shown in FIG. 2A and also in the succeeding views 2B to 2E).

On the detent spring element 21 two magnets 22, 23 are arranged, which are associated to two magnets 314, 315 on the plug 311. The magnets 22, 23 of the detent spring element 21 point towards the associated magnets 314, 315 with different poles such that for example the magnet 22 with a north pole points towards a south pole of the magnet 314, and the magnet 23 with a south pole points towards a north pole of the magnet 315. Correspondingly, the magnets 22, 23, 314, 315 magnetically attract each other, so that closing of the closure device 1 is magnetically supported and the plug 311 correspondingly is drawn into the receiving opening 200 of the housing 20 in the closing direction X. Closing thus at least largely is effected automatically and hence in a way haptically pleasant for a user.

Figure 2B:
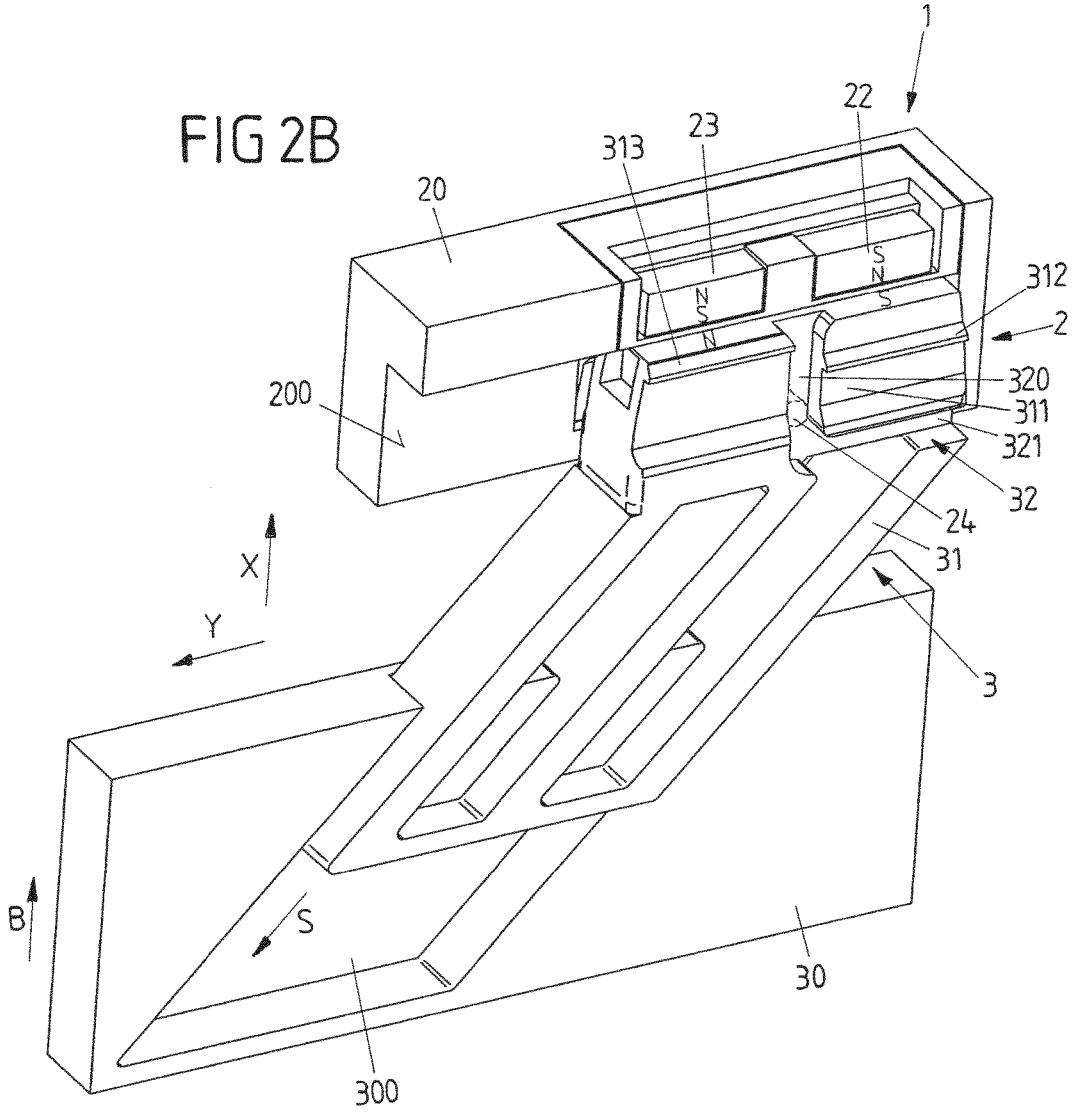
FIG. 2B shows a view of the closure device in a closed position.

FIG. 2B shows the closure device 1 in its closed position in which the plug 311 is inserted into the receiving opening 200 and the pairs of latching protrusions 312, 313 of the plug 311 latchingly are in engagement with the detent spring arms 210, 211 of the detent spring element 21. On closing, the pins 24 have passed through the first connecting link portion 320 of the respectively associated connecting link guideway 32 and now are at the break point between the first connecting link portion 320 and the second connecting link portion 321.

In the closed position, the closure parts 2, 3 thus are latchingly connected with each other via the detent spring element 21 and the latching protrusions 312, 313 of the plug 31, so that the plug 311 cannot be removed from the receiving opening 200 of the housing 20 against the closing direction X and the closure parts 2, 3 thus are held at each other in a firm, loadable way.

When the closure device 1 is to be opened from the closed position according to FIG. 2B, the second closure part 3 must be moved in the opening direction Y relative to the first closure part 2, in order to bring the latching protrusions 312, 313 out of engagement with the associated detent spring arms 312, 313 in the opening direction Y. In the illustrated exemplary embodiment, the actuation of the second closure part 3 is effected via the actuating element 30, on which the second closure part 3 is guided along the oblique guiding direction S. When the actuating element 30 is moved in an actuating direction B, the second closure part 3 with its guiding part 11 moves into the guiding device 300 and correspondingly, due to the oblique guidance provided by the guiding device 300, is moved in the opening direction Y, so that the latching protrusions 312, 313 are moved relative to the detent spring arms 210, 211 and are tangentially brought out of engagement with the same.

Figure 2C:
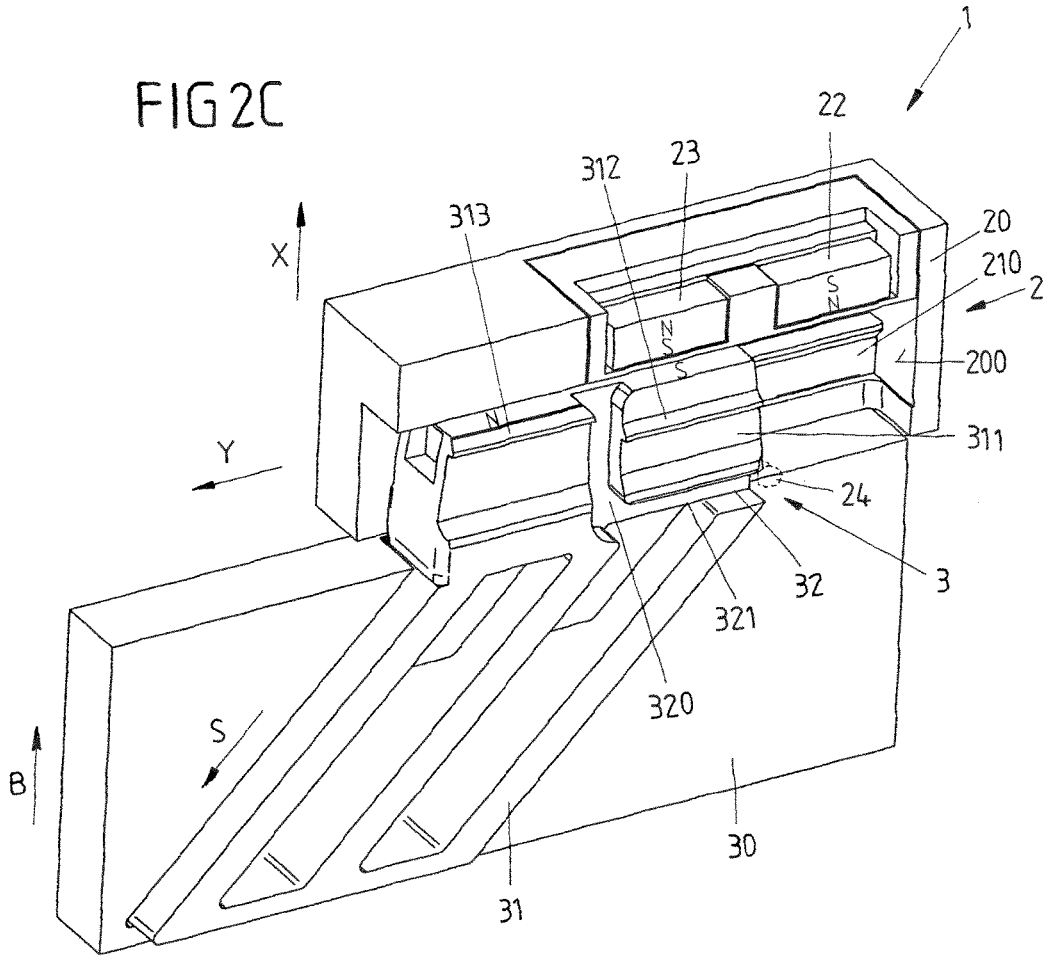
FIG. 2C shows a view of the closure device on opening.

FIG. 2C shows the closure device 1 in an open position. Due to the movement of the second closure part 3 in the opening direction Y, the pins 24 at the same time have been moved in the respectively associated connecting link guideway 32, wherein the pins 24 each have passed through the connecting link portion 321 extending along the opening direction Y.

By shifting the plug 311 relative to the housing 20, the magnets 22, 23, 314, 315 at the same time also have been shifted relative to each other along the opening direction Y. This effects that in the open position according to FIG. 2C the magnet 23 of the first closure part 2 has been shifted into a position facing the magnet 314 of the second closure part 3. The magnets 23, 314 now face each other with like poles, so that a force of magnetic repulsion acts between the magnets 23, 314 against the closing direction X.

Figure 2D:
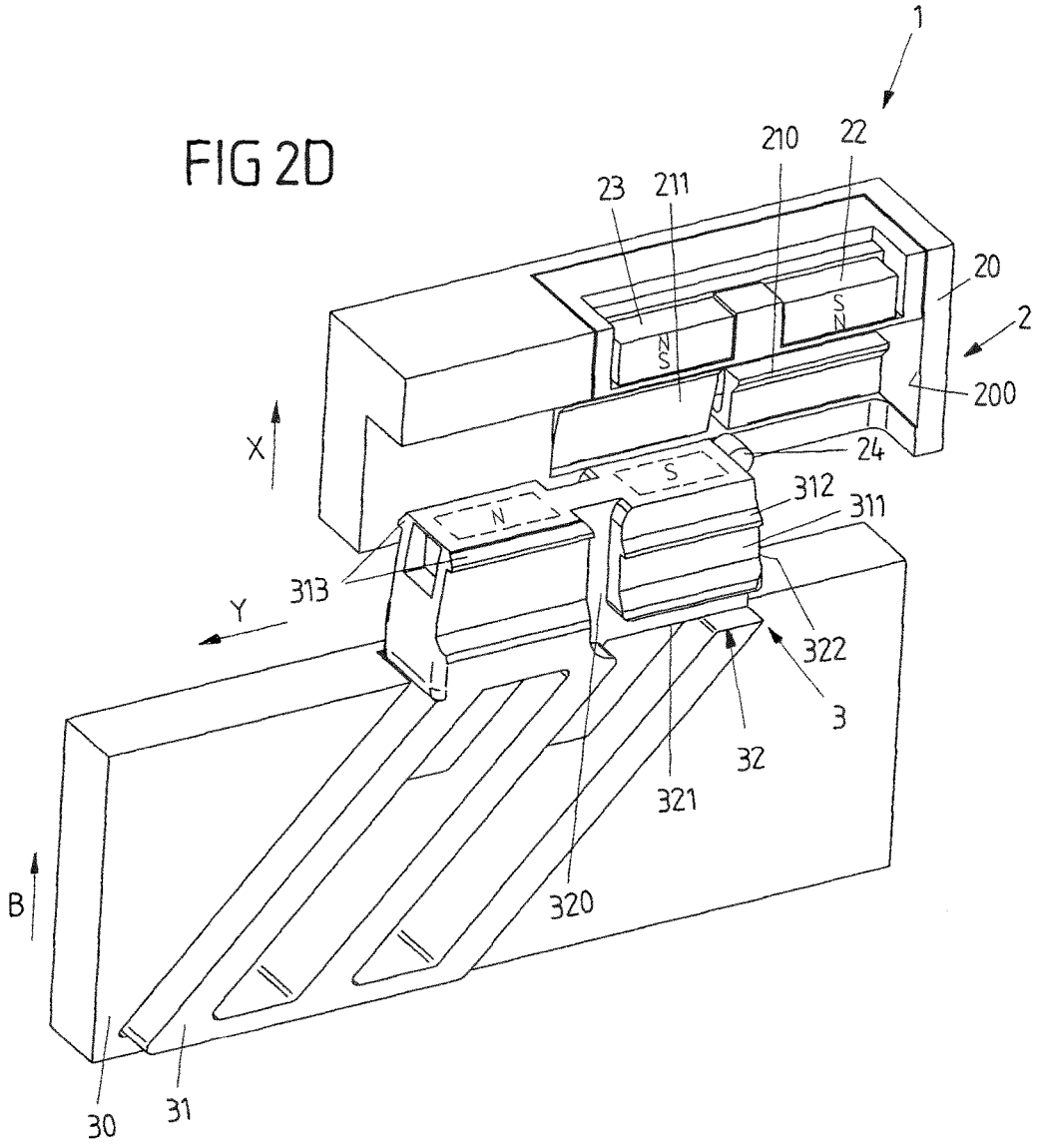
FIG. 2D shows a view of the closure device on separation of the closure parts.

The consequence is that the closure parts 2, 3 are separated from each other in a magnetically supported way against the closing direction X and for this purpose the plug 311 is ejected from the receiving opening 200. The pins 24 slide along the respectively associated abutment portions 322 on the back of the plug 311, so that on separation of the closure parts 2, 3 it is prevented that the second closure part 3 can be set back against the opening direction Y. In this way, it is prevented that after opening the closure device 1 can immediately snap shut again. This is shown in FIG. 2D.

A return movement of the closure parts 2, 3 relative to each other, i.e. a movement of the second closure part 3 back against the opening direction Y into a position in which the closure parts 2, 3 can again closingly be brought in engagement with each other, only is possible when the second closure part 3 with its plug 311 has been moved out of the receiving opening 200 of the housing 20 of the first closure part 2 to such an extent that the pins 24 have come out of contact with the abutment portions 322 of the plug 311. This is shown in FIG. 2E.

Figure 2E:
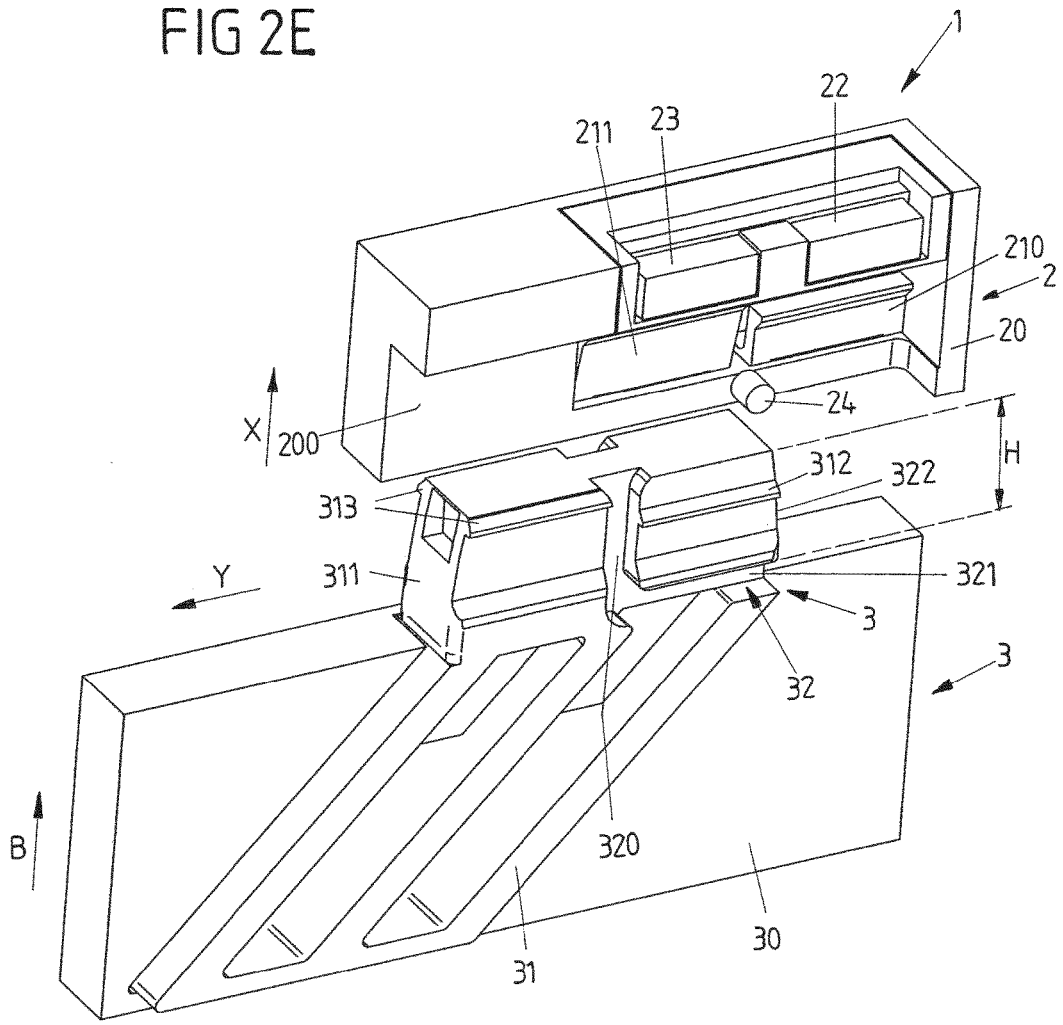
FIG. 2E shows a view of the closure device with separated closure parts.

From the position shown in FIG. 2E the plug 311 in turn can be brought into a position in which the magnets 22, 23, 314, 315 attractingly face each other in pairs and the pins 24 are located in the region of the connecting link portions 320 of the connecting link guideways 32, so that the second closure part 3 in turn can be attached to the first closure part 2 in the closing direction X. This state corresponds to the state shown in FIG. 2A.

Between the actuating element 30 and the guiding part 31 of the second closure part 3, a pretensioning spring 30 advantageously can be arranged, which pretensions the guiding part 31 in direction of the extended position (FIG. 2A). The pretensioning spring 305 for example can be formed as compression spring, which on retraction of the guiding part 31 into the open position of the closure device 1 as shown in FIG. 2C is tensioned under pressure and for extension of the second closure part 3 into the position according to FIG. 2A after opening and separation of the closure device 1 acts on the guiding part 31.

There is obtained a circulating movement, in which for closing the second closure part 3 is attached to the first closure part 2 in the closing direction X, for opening the second closure part 3 is moved in the opening direction Y relative to the first closure part 2, for separating the second closure part 3 is moved against the closing direction X relative to the first closure part 2, and for resetting the second closure part 3 again is shifted in its starting position against the opening direction.

Due to the fact that on separation the pins 24 slide along the abutment portions 322 on the back of the plug 311, a return movement only can be effected after the plugs 24 have come out of contact with the abutment portions 322 of the plug 311. At least along a path H, which corresponds to the height of the plug 311 (see FIG. 2E), a return movement on separation thus is impossible, so that it is prevented safely and reliably that the closure device 1 immediately can snap shut again after opening.

Due to the fact that the actuating element 30 also is coupled with the second closure part 3 via a forced guidance, an actuation of the second closure part 3 is obtained for opening, which e.g. can advantageously be used in combination with a piece of furniture, e.g. a drawer or a sliding door. For example, the actuating element 30 can be formed integrally with a drawer, wherein the actuation of the closure device 1 is effected by pressing on the drawer and correspondingly a movement of the actuating element 30 is effected in the actuating direction B corresponding to the closing direction X. By pressing on the drawer (or correspondingly the sliding door), the second closure part 3 thus can be moved in the opening direction Y, wherein via the guiding device 300 and the movement of the guiding part 31 in the oblique guiding direction S the actuating movement of the actuating element 30 in the actuating direction B is converted into the opening movement of the second closure part 3 in the opening direction Y.

Figure 3A:
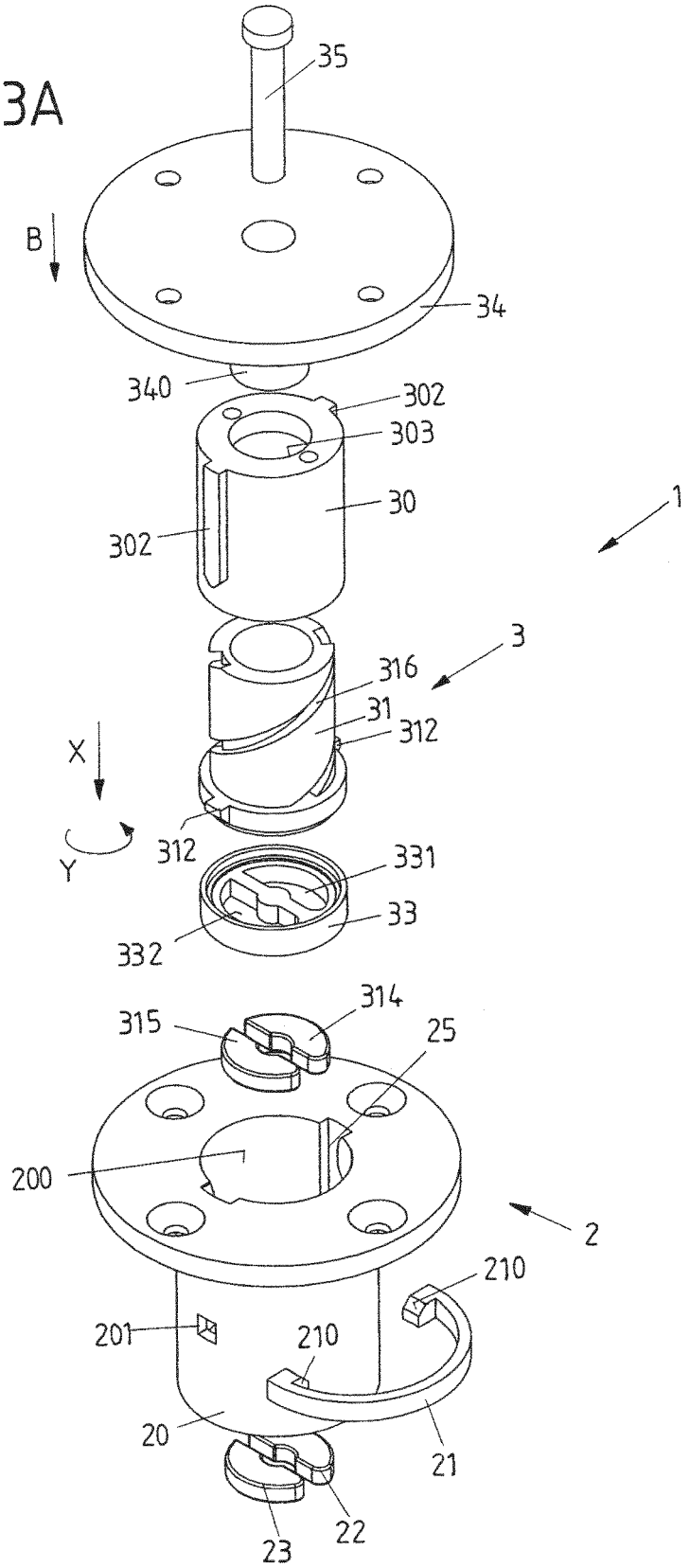
FIG. 3A shows an exploded view of a second exemplary embodiment of a closure device.
Figure 3B:
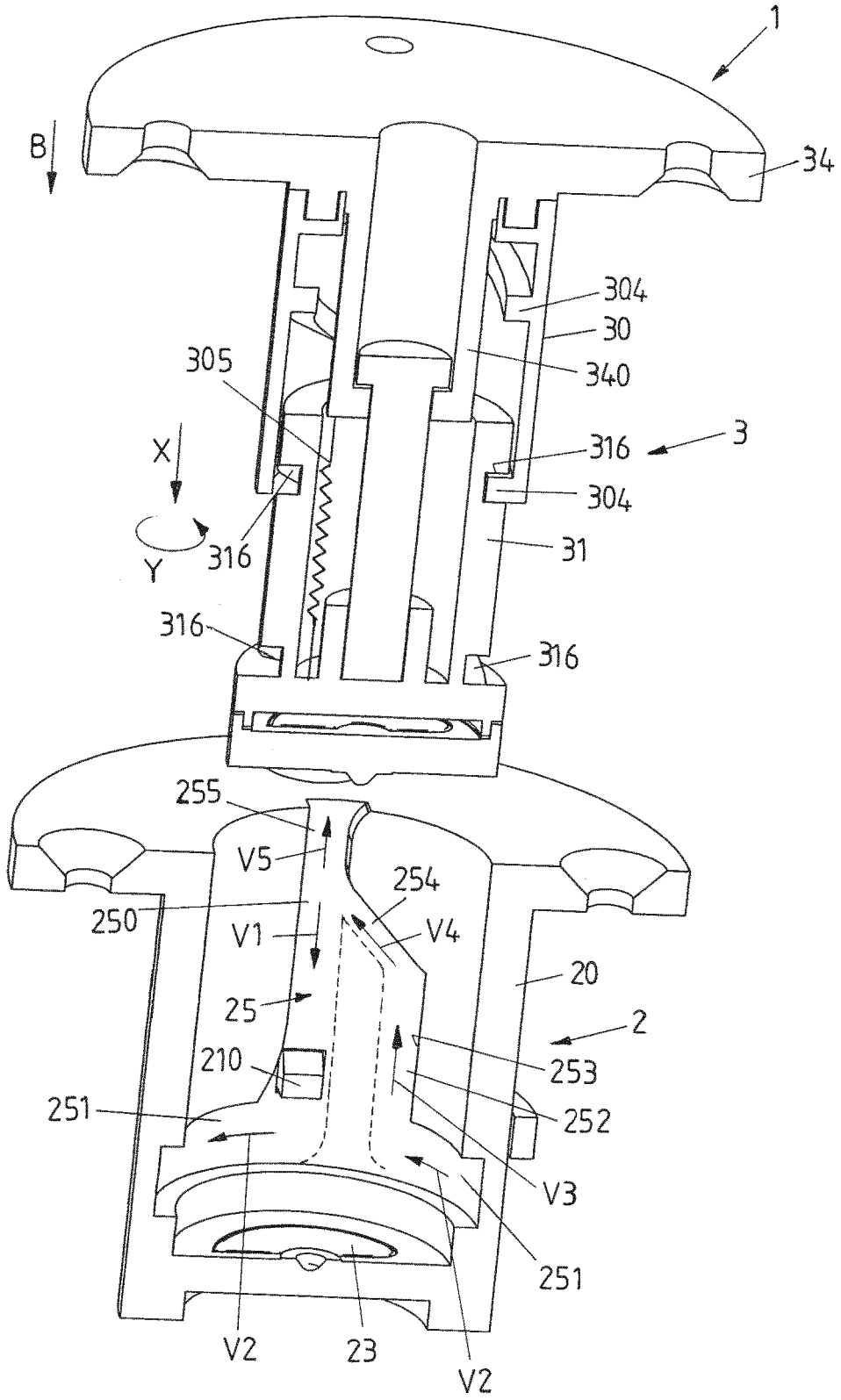
FIG. 3B shows a partial sectional view of the closure device before closing.
Figure 4A:
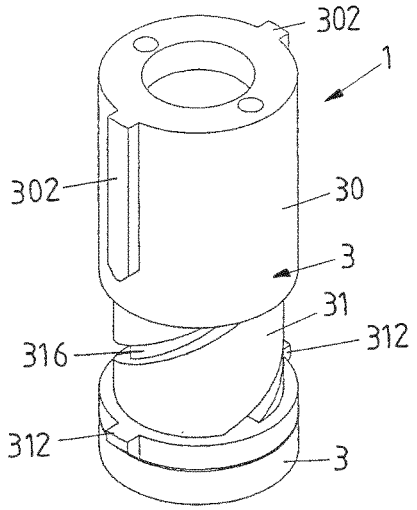
FIGS. 4A-4H show perspective views of the closure device in different states.
Figure 5A:
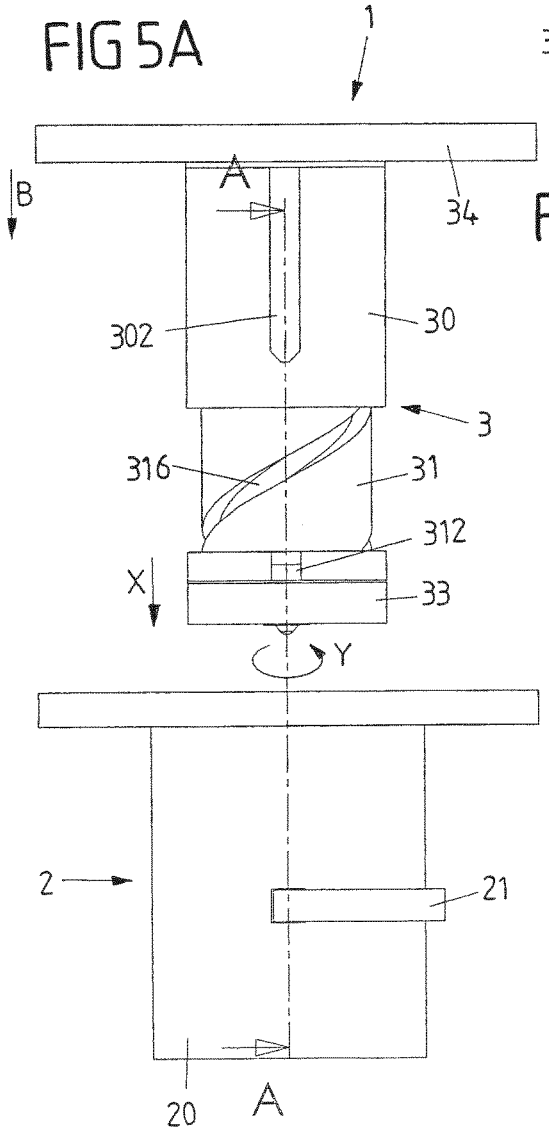
FIGS. 5A-5H show side views of the closure device in different states.
Figure 6A:
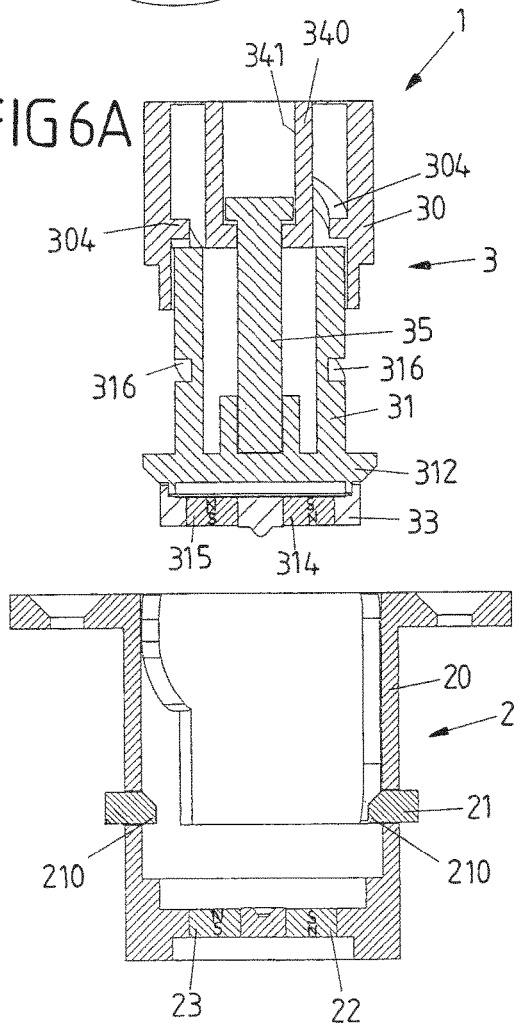
FIGS. 6A-6H show sectional views along line A-A in the respectively associated FIGS. 5A-5H.

Another exemplary embodiment of a closure device 1 is shown in FIGS. 3A, 3B to 6A-6H. FIG. 3A and FIG. 3B show an exploded view and a partial sectional view of the closure device 1. FIGS. 4A-4H, FIGS. 5A-5H and 6A-6H show the closure device 1 in different views and different states, wherein FIGS. 4A-4H show perspective views, FIGS. 5A-5H side views, and FIGS. 6A-6H sectional views along the line A-A according to FIGS. 5A-5H. The Figures designated with "A", "B" etc. each represent the same state, so that FIGS. 4A, 5A and 6A show a first state, FIGS. 4B, 5B and 6B a second state, etc.

The closure device 1 includes a first closure part 2 and a second closure part 3.

The first closure part 2 comprises a housing 20 to which a semi-circular detent spring element 21 is attached such that detent spring arms 210 reach through opposed cutouts 201 and protrude into an inner receiving opening 200 of the housing 20. On a bottom of the housing 20 magnets 22, 23 are arranged, as can be seen for example in FIG. 2B.

The second closure part 3 is guided on an actuating element 30 which is firmly connected with an actuating part 34. On a cylindrical shell surface of the actuating element 30 two webs 302 are arranged, which extend axially along a closing direction X on the outside of the actuating element 30.

In the actuating element 30 a guiding part 31 of the second closure part 3 is arranged and via two thread grooves 316 guided on thread webs 304 (see for example FIG. 3B). Latching protrusions 312 provided on both sides radially protrude from the guiding part 31 to the outside. With the bottom of the guiding part 31 a holding part 33 is connected, on which magnets 314, 315 are held at receiving openings 331, 332.

The guiding part 31 is connected with a bolt 35 which reaches through a pin 340 of the actuating part 34 such that the guiding part 31 is movable along the closing direction X relative to the actuating part 34 at least by a predetermined actuating path. Due to the forced guidance provided via the thread grooves 316 and the thread webs 304, a movement of the guiding part 31 relative to the actuating element 30 results in a rotary movement of the guiding part 31 relative to the actuating element 30, as will yet be explained below.

On the inner receiving opening 200 of the housing 20 of the first closure part 2 a connecting link guideway 25 is arranged, which serves for guiding a latching protrusion 312 as well as a web 302 and for this purpose includes different connecting link portions 250, 251, 252, 254. On the cylindrical inner wall of the receiving opening 200 (analogous to the connecting link guideways 32 provided on both sides in the exemplary embodiment according to FIGS. 1 and 2) two connecting link guideways 25 are arranged, which are arranged on the inner wall of the receiving opening 200 offset by 180° around the closing direction X and each serve for guiding a latching protrusion 312 or web 302.

The mode of operation of the closure device 1 will be explained below with reference to FIGS. 4A-4H, 5A-5H and 6A-6H.

In a state before closing, shown in FIGS. 4A, 5A and 6A, the closure parts 2, 3 are present separate from each other. The guiding part 31 here is extended from the actuating element 30, as shown for example in FIG. 5A. The webs 302 and the latching protrusions 312 each are aligned with each other in pairs—as seen along the closing direction X.

In this exemplary embodiment, too, a pretensioning spring 305 (see FIG. 3B) advantageously can be provided, which acts between the actuating element 30 and the guiding part 31 and after opening and separation of the closure device 1 guides the closure part 3 back into the starting position according to FIG. 3A. In this exemplary embodiment, the pretensioning spring 305 for example can be formed as compression spring, which extends around the bolt 305, surrounds the bolt 305 and for this purpose is arranged in a cutout within the guiding part 31.

Figure 4B:
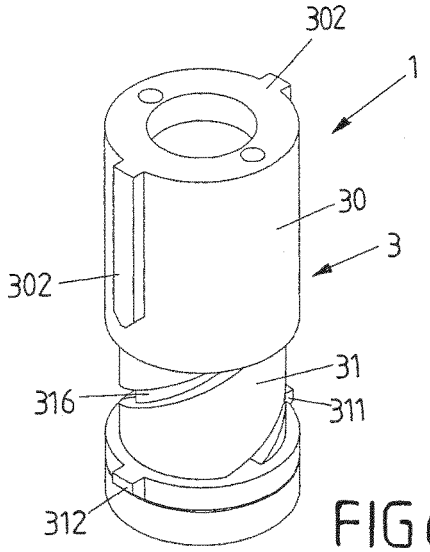
Figure 5B:
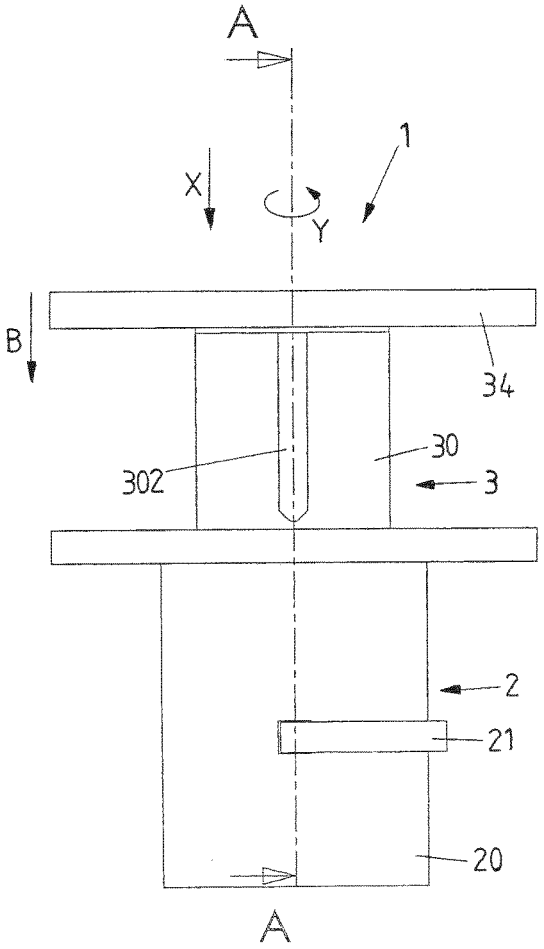
Figure 6B:
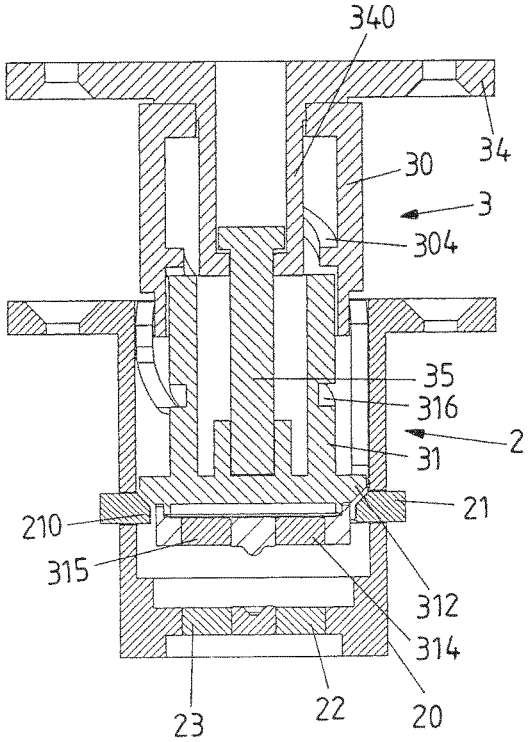

In this position before closing, the magnets 314, 315, 22, 23 each face each other in pairs with unlike poles, as is schematically shown in FIG. 6A, which results in a force of magnetic attraction between the first closure part 2 and the second closure part 3. When, as shown in FIGS. 4B, 5B and 6B, the second closure part is inserted into the receiving opening 200 of the housing 20 of the first closure part 2 in the closing direction X, the latching protrusions 312 slide into associated entry points 255 of the two connecting link guideways 25 provided on the receiving opening 200 and, as shown in FIG. 6B, run along the connecting link portions 250 in a direction of movement V1 (see FIG. 3B) onto the detent spring arms 210 of the detent spring element 21.

Figure 4C:
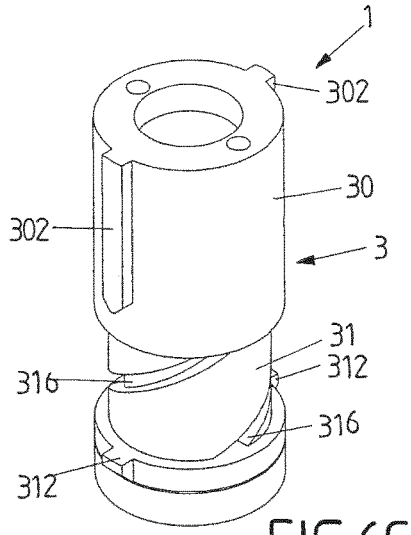
Figure 5C:
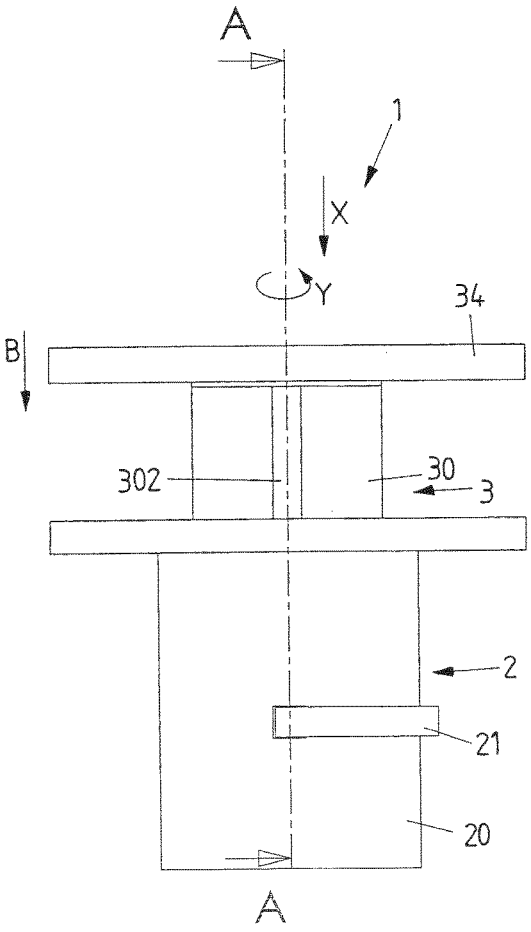
Figure 6C:
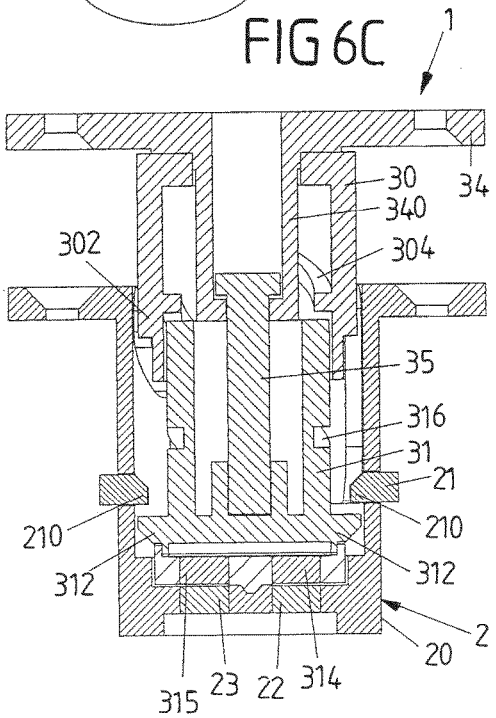

Due to the elastically resilient design of the detent spring element 21, the detent spring arms 210 can yield radially to the outside, so that the latching protrusions 312 urge the detent spring arms 210 aside and latchingly get in engagement with the detent spring arms, as is shown in FIGS. 4C, 5C and 6C. In the closed position as shown in FIGS. 4C, 5C and 6C, the latching protrusions 312 engage behind the detent spring arms 210, so that the first closure part 2 and the second closure part 3 are mechanically latched with each other and the second closure part 3 thus cannot (no longer) be removed from the first closure part 2 against the closing direction X.

Closing largely is effected automatically due to the force of magnetic attraction between the magnets 22, 23, 314, 315. In the closed position, the magnets 22, 23, 314, 315 each face each other in pairs with unlike poles, so that the closure parts 2, 3 also are magnetically held in position to each other.

On closing, there is no relative movement between the guiding part 31 and the actuating element 30. Due to the magnetic attraction, the actuating element 30 together with the guiding part 31 is drawn into the receiving opening 200 of the housing 20 of the first closure part 2, so that in the closed position, as shown in FIG. 6C, the webs 302 have moved into the entry points 255 of the two connecting link guideways 25 and the actuating element 30 thus is non-rotatably held at the housing 20 of the first closure part 2.

Figure 4D:
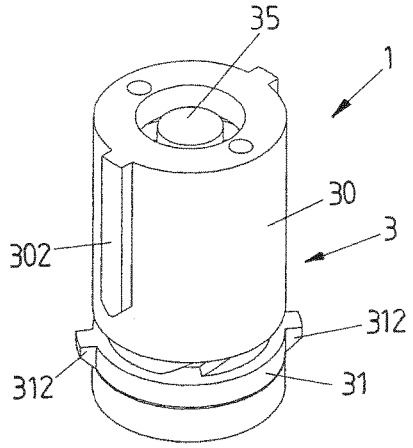
Figure 5D:
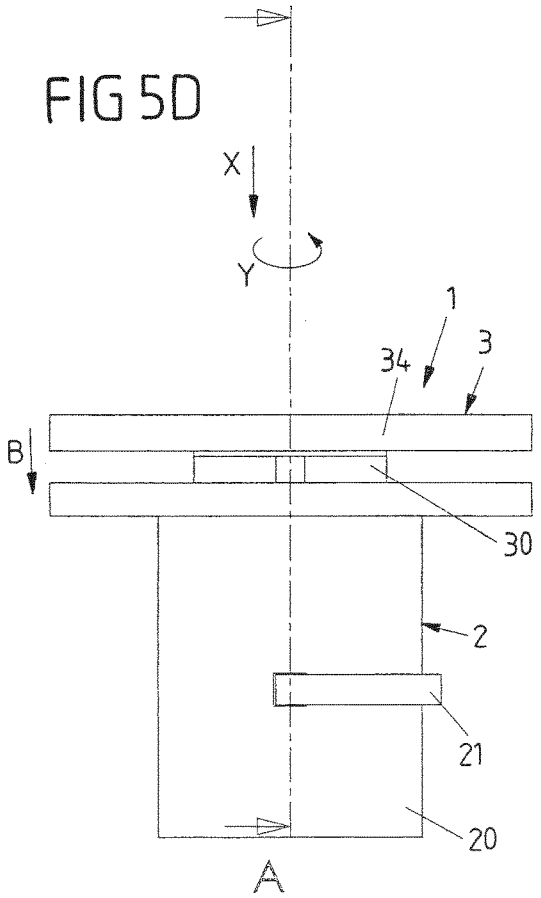
Figure 6D:
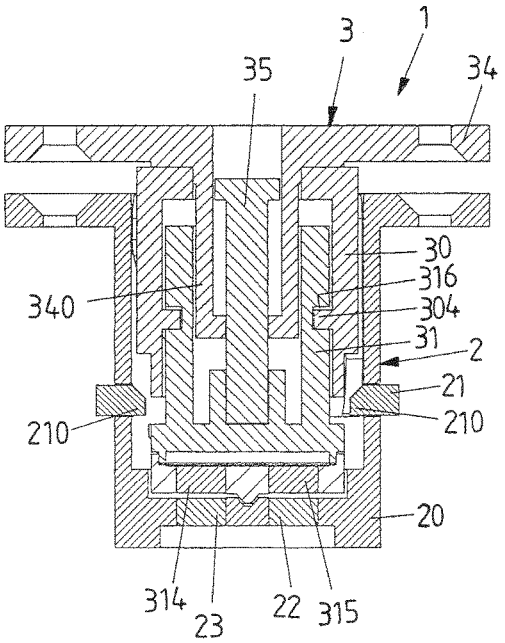
Figure 4E:
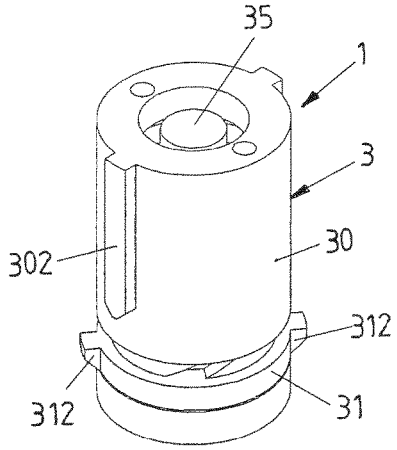
Figure 5E:
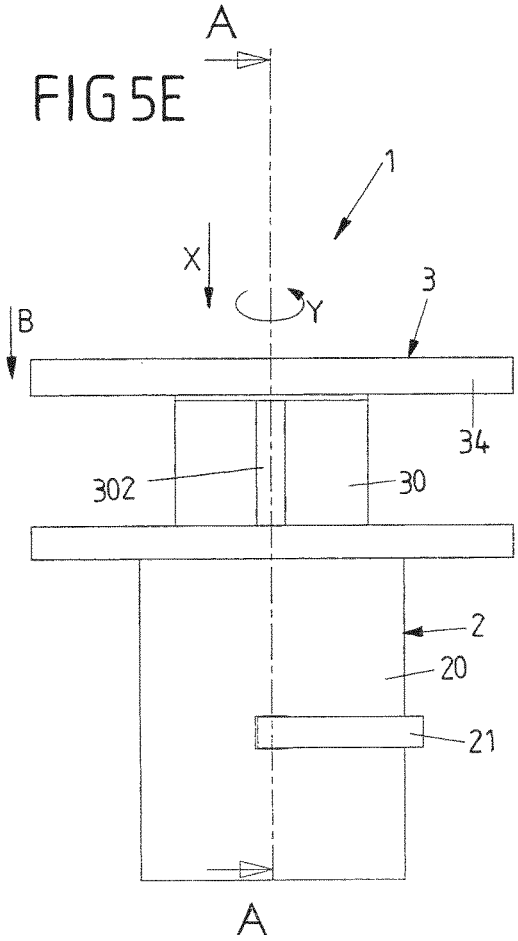
Figure 6E:
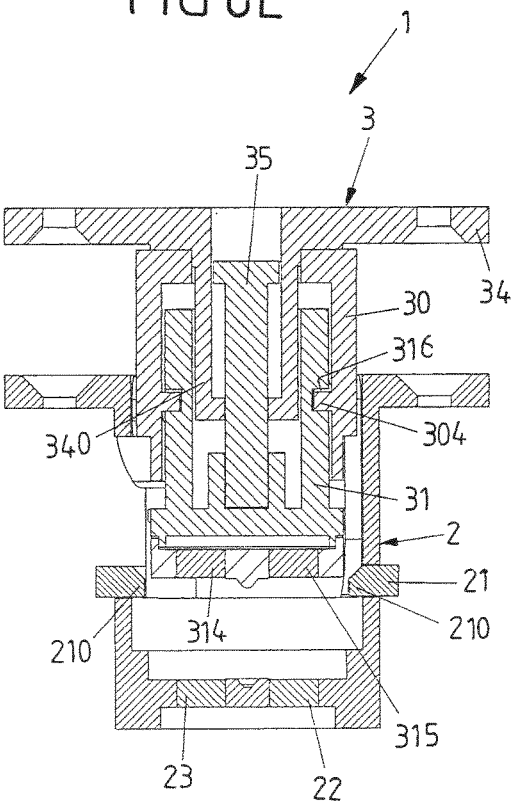

When the closure device 1 is to be opened from the closed position according to FIGS. 4C, 5C and 6C, the actuating element 30 is pressed into the receiving opening 200 of the housing 20 of the first closure part 2 by pressing on the actuating part 34 in an actuating direction B corresponding to the closing direction X, as is shown in FIGS. 4D, 5D and 6D. Due to the forced guidance between the actuating element 30 and the guiding part 31 via the thread guidance realized by the thread grooves 316 and the thread webs 304, the guiding part 31 is twisted in an opening direction Y (which rotatorily is directed around the closing direction X), so that the latching protrusions 312 each move into a connecting link portion 251 in a direction of movement V2 (see FIG. 3B). The guiding part 31 here is rotated by slightly less than 180°, so that each latching protrusion 312 is moved towards the opposed connecting link guideway 25 (in FIG. 3B only one connecting link guideway 25 is shown). When each latching protrusion 312 has reached the associated connecting link portion 252, the latching protrusion 312 moves into the connecting link portion 252 and moves in a direction of movement V3 against the closing direction X, and due to the magnets 22, 23, 314, 315 now facing each other in a repelling manner, which have been twisted together with the guiding part 31, effects that like poles of the magnets 22, 23, 314, 315 face each other in pairs and thus repel each other. The latching protrusions 312 thus move past the detent spring arms 210 of the detent spring element 21 along the connecting link portions 252, so that the second closure part 3 can be removed from the receiving opening 200 of the housing 20 of the first closure part 2. This is shown in FIGS. 4E, 5E and 6E.

For unlocking, the guiding part 31 is twisted by slightly less than 180° by actuating the actuating element 30 in the actuating direction B, so that the latching protrusions 312 just can move into the respectively associated connecting link portion 252 of the opposed connecting link guideway 25. The latching protrusions 312 each get in contact with an abutment portion 253 which laterally defines the connecting link portion 252 and effects that when the second closure part 3 is removed from the receiving opening 200, the guiding part 31 cannot be pivoted back against the opening direction Y. The abutment portions 253 of the two connecting link guideways 25 thus realize blocking means for blocking a return movement of the guiding part 31.

Figure 4F:
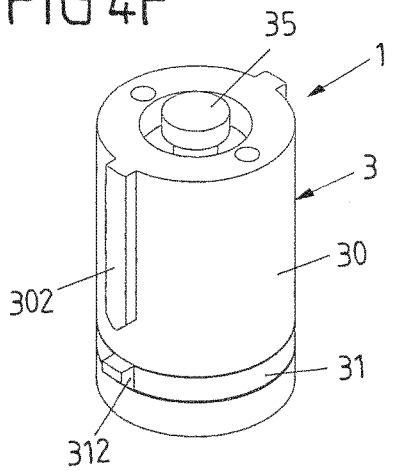
Figure 5F:
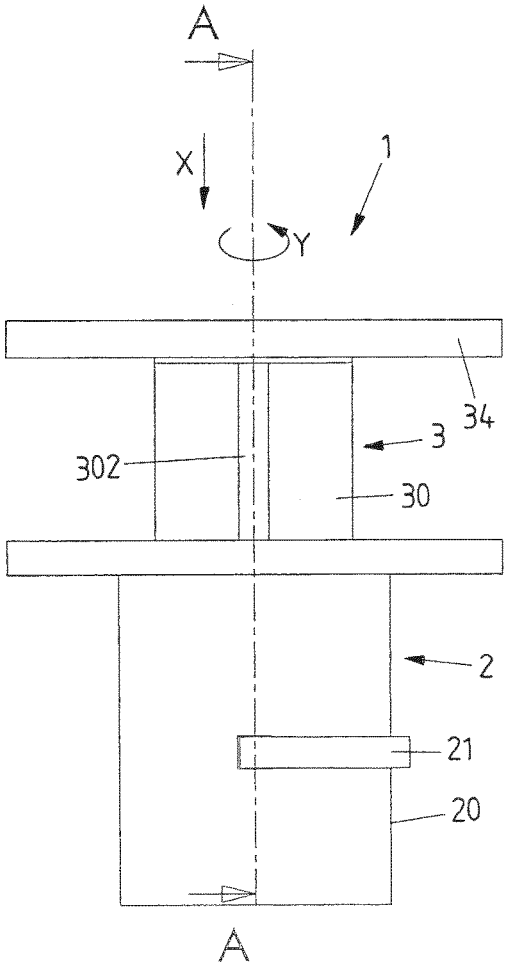
Figure 6F:
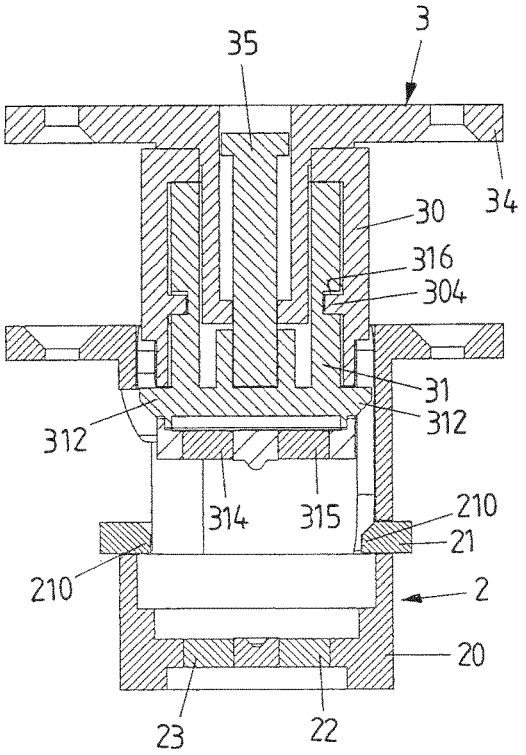
Figure 5G:
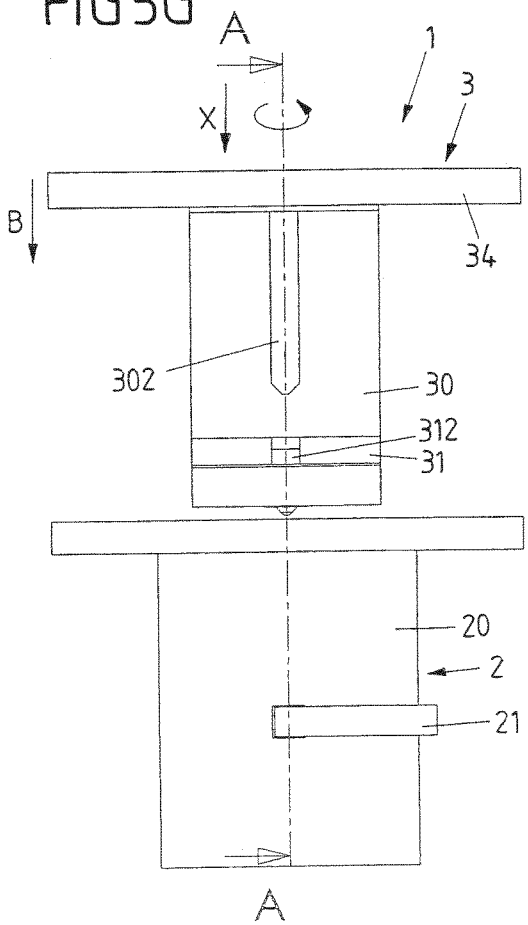
Figure 6G:
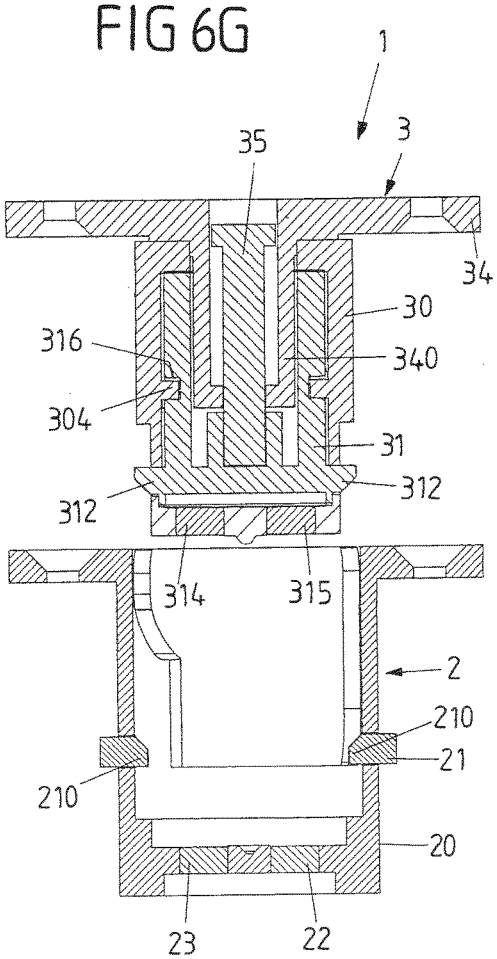

When the latching protrusions 312 slide further along the connecting link guideway 25 during the removal of the guiding part 31, they enter into the respectively associated connecting link portion 254 and thus are obliquely shifted in a direction of movement V4 in direction of the entry point 255 of the associated connecting link guideway 25. Due to this oblique guidance, the guiding part 31 is twisted further relative to the actuating element 30, so that the guiding part 31 now is twisted by exactly 180° relative to the actuating element 30. In this position, the latching protrusions 312 and also the webs 302 exit from the entry points 255 of the connecting link guideways 25, as is shown in FIGS. 4F, 5F and 6F.

Figure 4G:
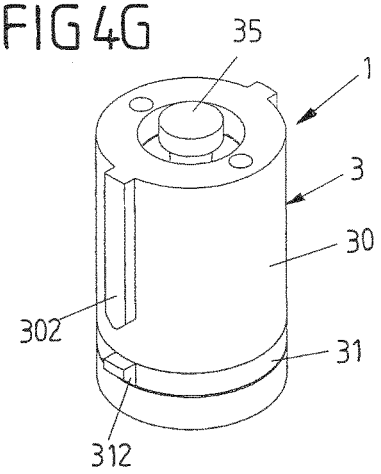
Figure 4H:
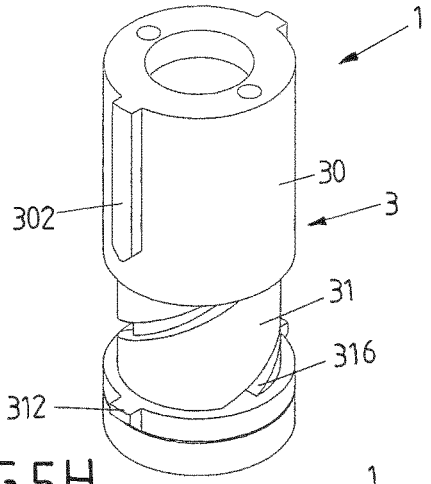
Figure 5H:
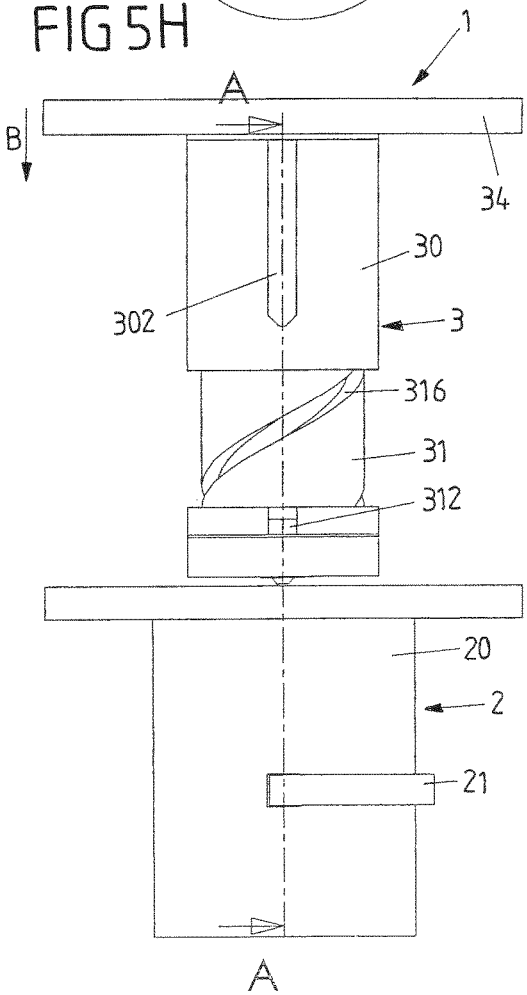
Figure 6H:
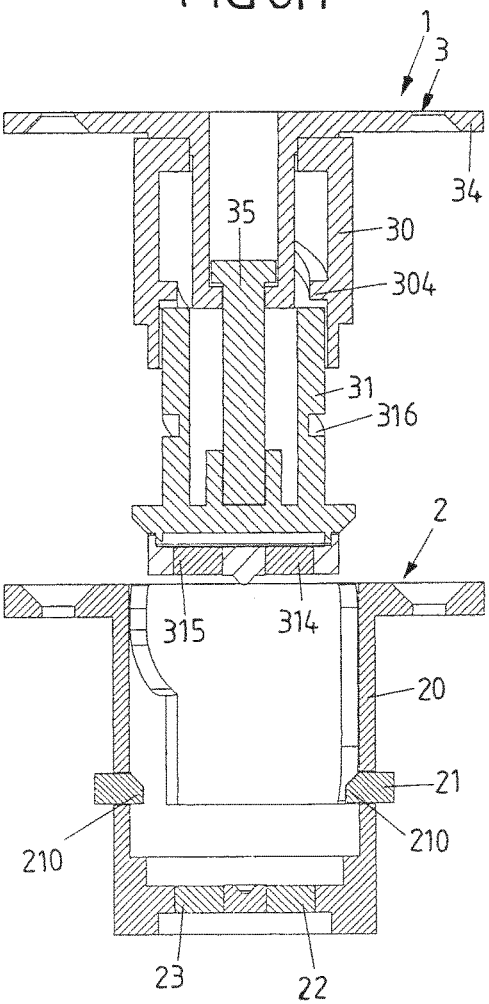
Figure 7:
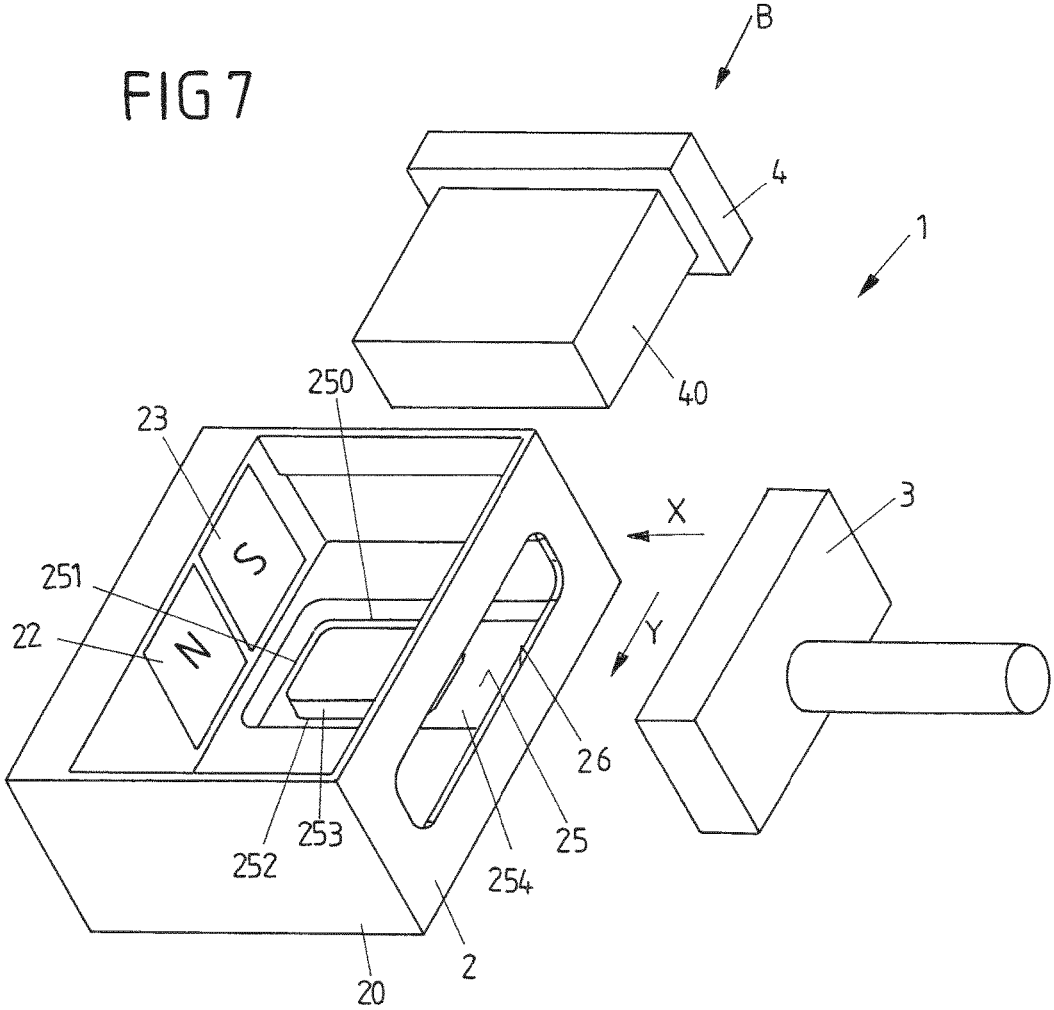
FIG. 7 shows an exploded view of another exemplary embodiment of a closure device.
Figure 8:
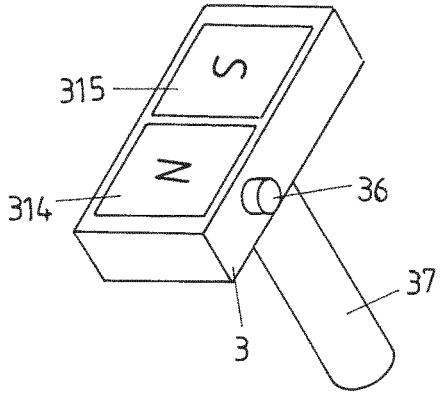
FIG. 8 shows a separate view of a closure part of the closure device according to FIG. 7.

After removing the second closure part 3 from the receiving opening 200 of the housing 20 of the first closure part 2 (see FIGS. 4G, 5G and 6G), the guiding part 31 then can again be moved out of the actuating element 30, wherein for this purpose for example a spring pretension can be provided between the actuating element 30 and the guiding part 31, which effects an automatic reset into the initial state as shown in FIGS. 4H, 5H and 6H.

Due to the thread guidance between the actuating element 30 and the guiding part 31, a compressive force acting on the actuating element 30 is converted into a twisting movement of the guiding part 31 for opening the closure device 1.

In this exemplary embodiment, too, blocking mans are realized by two connecting link guideways 25, which include abutment portions 253 which on separation of the closure parts 2, 3 from each other (shown in FIGS. 4E, 5E, 6E and 4F, 5F, 6F) block a return movement of the guiding part 31 against the opening direction Y.

A further exemplary embodiment of a closure device 1, which is shown in FIGS. 7, 8 and 9A to 9D, includes two closure parts 2, 3 of which a second closure part 3 is at least partly enclosed by a first closure part 2 and with a stem 37 reaches through an opening 26. The second closure part 3 can be brought into different positions relative to the first closure part 2, but cannot completely be released from the first closure part 2.

With a pin 36 (see FIG. 8) the second closure part 3 rests in a connecting link guideway 25 of the first closure part 2 and in this way is guided on the first closure part 2. For closing, the second closure part 3 is approached in a closing direction X towards a bottom of the first closure part 2 carrying magnets 22, 23, wherein magnets 314, 315 of the second closure part 3 (see FIG. 8) face the magnets 22, 23 of the first closure part 2 with unlike poles, and thus a force of magnetic attraction is effected on closing of the closure device 1. On closing, the pin 36 slides along a connecting link portion 250 of the connecting link guideway 25.

Figure 9A:
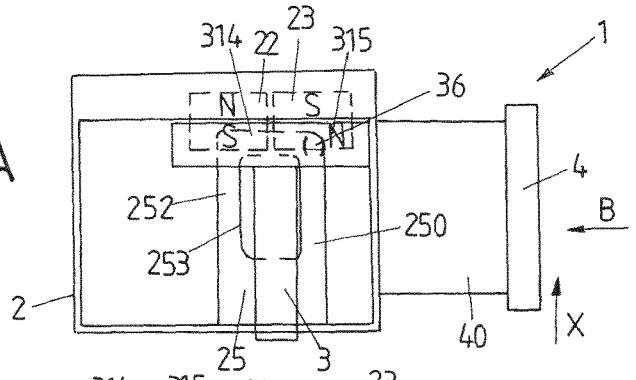
FIGS. 9A-9D show views of the closure device in different states.
Figure 9B:
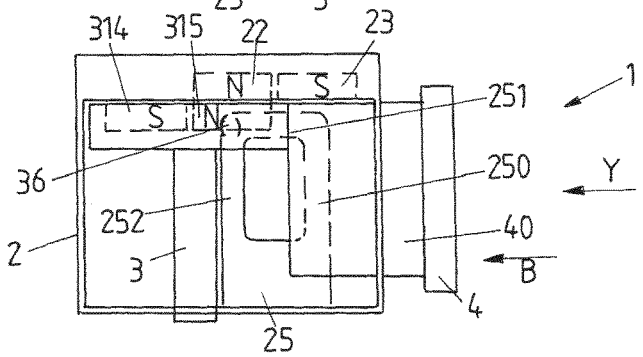

FIG. 9A shows the closure device 1 in a closed position in which the second closure part 3 is magnetically held on the bottom of the first closure part 2 carrying the magnets 22, 23.

Figure 9C:
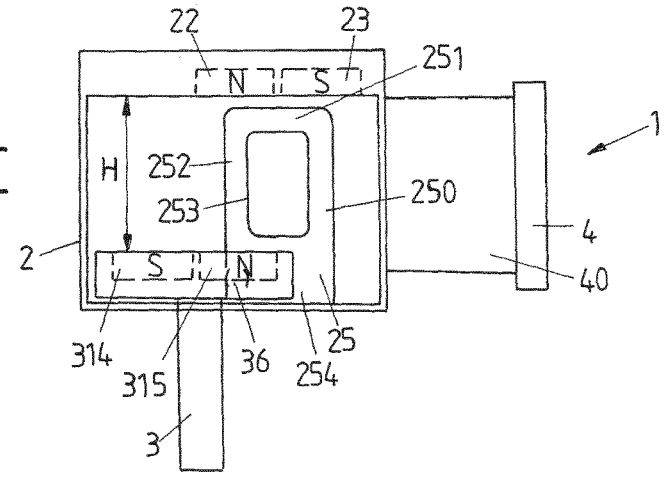

For opening, an actuating element 4 can be moved in an actuating direction B, in order to move the second closure part 3 in the actuating direction B relative to the first closure part 2. With its pin 36 the second closure part 3 slides into a connecting link portion 251 of the connecting link guideway 25 and moves in an opening direction Y relative to the bottom of the first closure part 2 carrying the magnets 22, 23, so that like magnets 22, 315 of the first closure part 2 and of the second closure part 3 are moved into an opposed position and thus a force of magnetic repulsion is effected, which effects a separation of the second closure part 3 from the bottom of the first closure part 2 carrying the magnets 22, 23 against the closing direction X. As shown in FIG. 9C, the pin 36 moves into a connecting link portion 252, wherein an abutment portion 253 laterally defining the connecting link portion 252 prevents a return movement of the second closure part 3 against the opening direction Y.

Figure 9D:
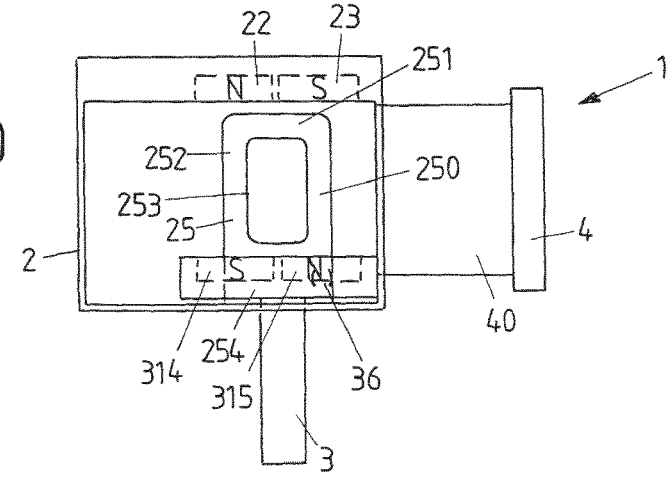
Figure 10A:
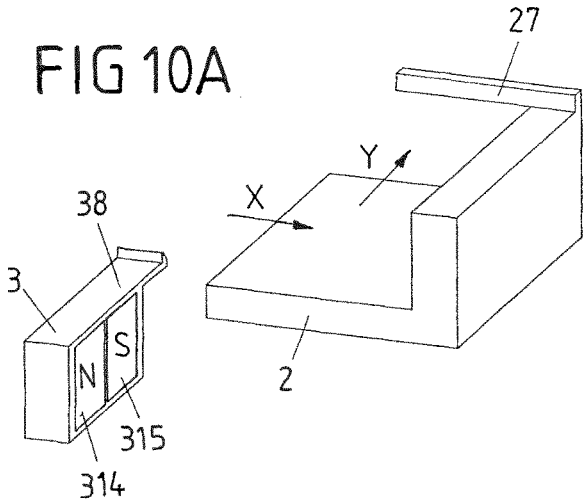
FIG. 10A shows a first exploded view of another exemplary embodiment of a closure device.
Figure 10B:
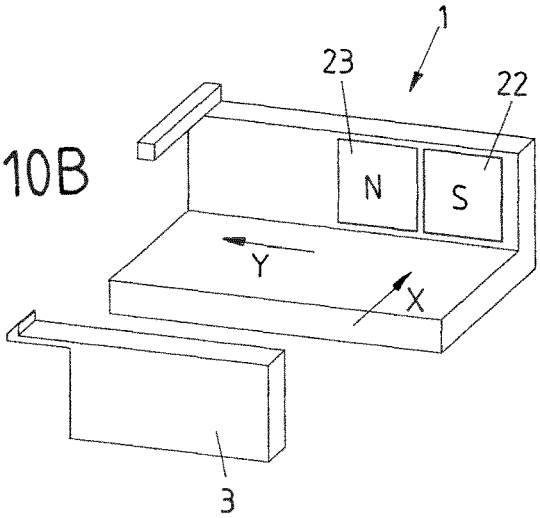
FIG. 10B shows the exploded view according to FIG. 10A from another perspective.
Figure 11:
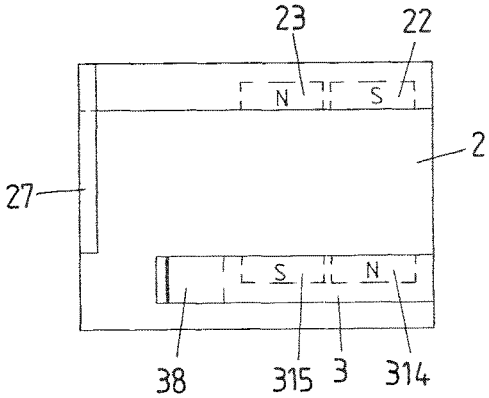
FIG. 11 shows a side view of the closure device on closing.

When the second closure part 3 has been moved by a path H corresponding to the height of the connecting link portion 252, the pin 36 no longer rests against the abutment portion 253, so that the second closure part 3 can be set back in its starting position according to FIG. 9D against the opening direction Y. This return movement can be effected by action of the magnets 22, 23, 314, 315, which exert a resetting force in direction of the starting position of the second closure part 3. In addition, further resetting means, for example a mechanical spring, can be provided, which spring is tensioned when the second closure part 3 is moved in the opening direction Y (transition from FIG. 9A to 9B), in order to then effect a return into the starting position after separation has been effected (transition from FIG. 9C to 9D).

Figure 12A:
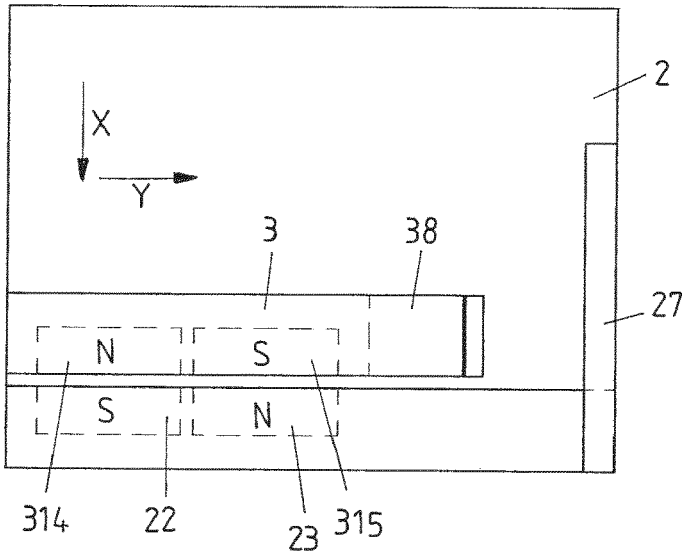
FIGS. 12A-12D show side views of the closure device in different states.
Figure 13A:
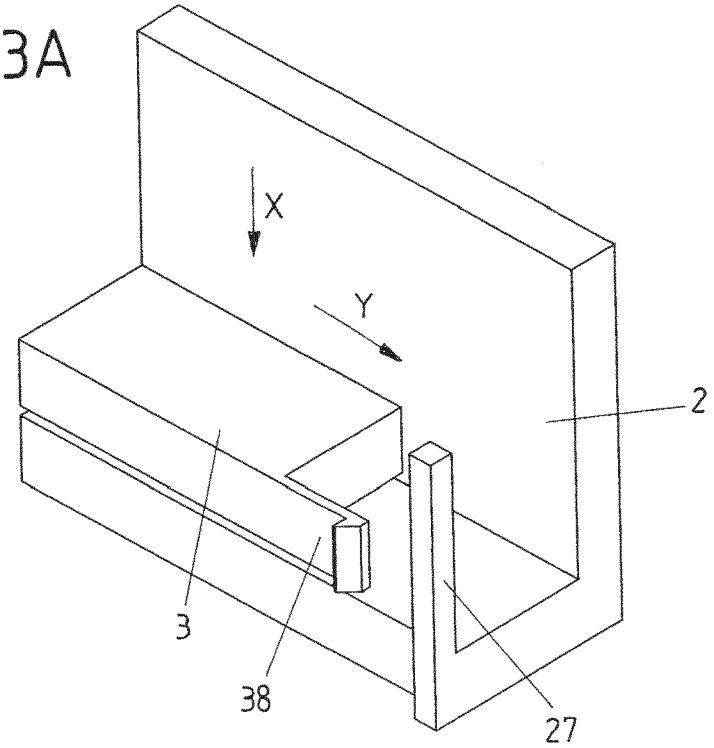
FIGS. 13A-13D show perspective views of the closure device in different states.

In a further exemplary embodiment shown in FIGS. 10A, 10B, 11, 12A to 12D a closure device 1 includes two closure parts 2, 3. Before closing, the closure parts 2, 3 are present separate from each other (see FIGS. 10A, 10B and 11). On each of the closure parts 2, 3 magnets 22, 23, 314, 315 are arranged, which effect a force of magnetic attraction to each other, so that when the closure parts 2, 3 are attached to each other, a second closure part 3 automatically is drawn into the closed position as shown in FIGS. 12A, 13A. In the closed position, the magnets 22, 23, 314, 315 face each other in a magnetically attracting manner, so that the second closure part 3 is held at the first closure part 2.

Figure 12B:
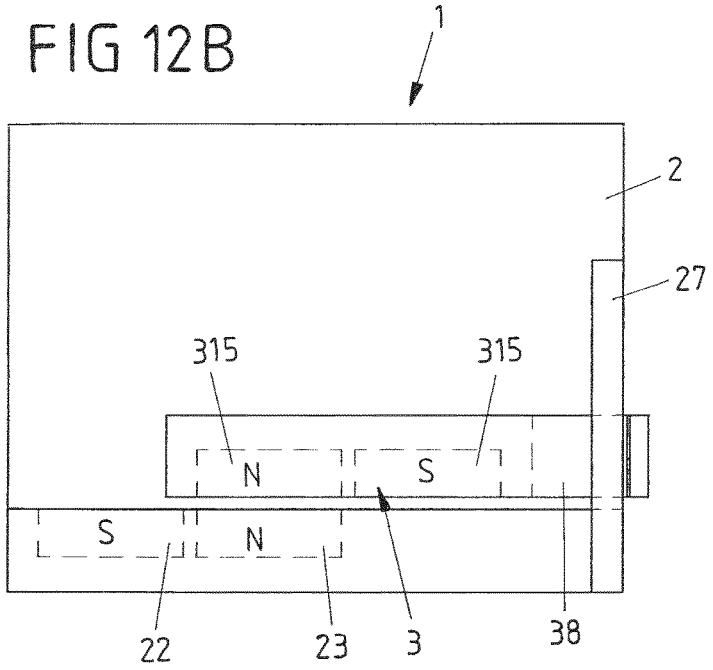
Figure 13B:
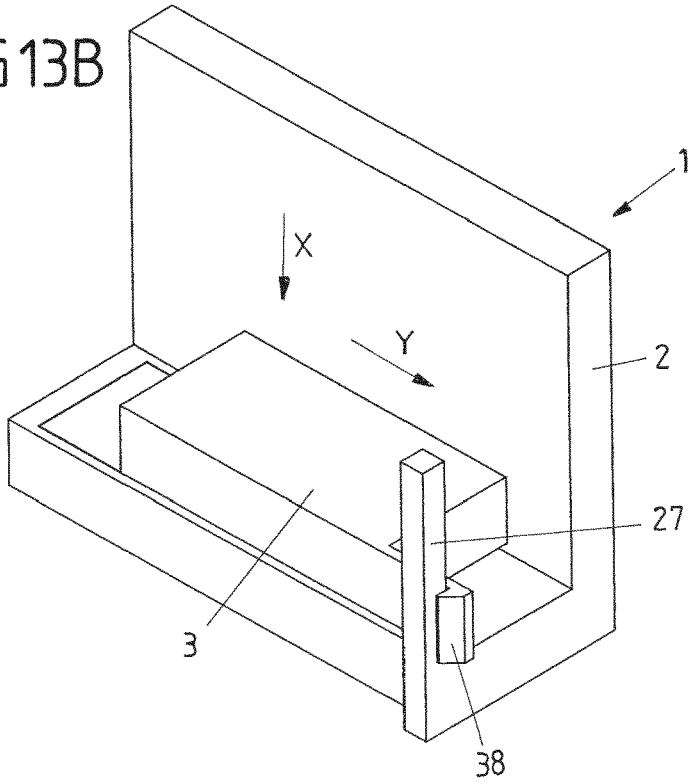

For opening, the second closure part 3 is moved in an opening direction Y relative to the first closure part 2 (see FIGS. 12B, 13B). The magnets 22, 23 on the one hand are tangentially shifted ("sheared off") relative to the magnets 314, 315, so that the force of magnetic attraction in the closed position is reversed into a force of repulsion (see FIG. 12B). In addition, a latching hook 38 of the second closure part 3 latchingly gets in engagement with a snap-in guide 27 of the first closure part 2, so that a movement of the second closure part 3 back against the opening direction Y is blocked. The snap-in guide 27 in so far realizes a blocking means.

The snap-in guide 27 is designed such that a return movement of the second closure part 3 against the opening direction Y is blocked, but at the same time the closure parts 2, 3 can be separated from each other against the closing direction X. Separating here is supported magnetically due to the force of repulsion acting on separation, wherein due to the snap-in guide 27 the closure parts 2, 3 cannot directly return into their closed position and the closure device 1 thus cannot directly snap shut again.

Figure 12C:
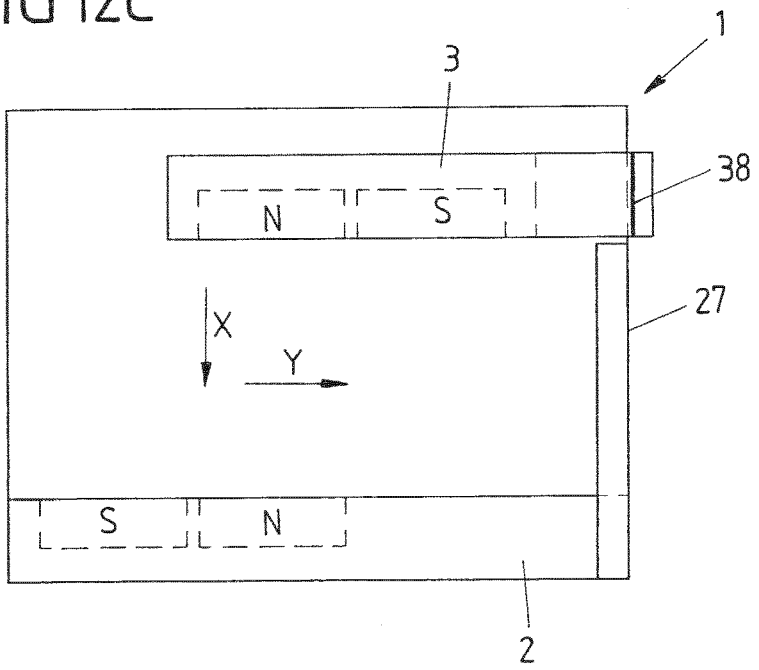
Figure 13C:
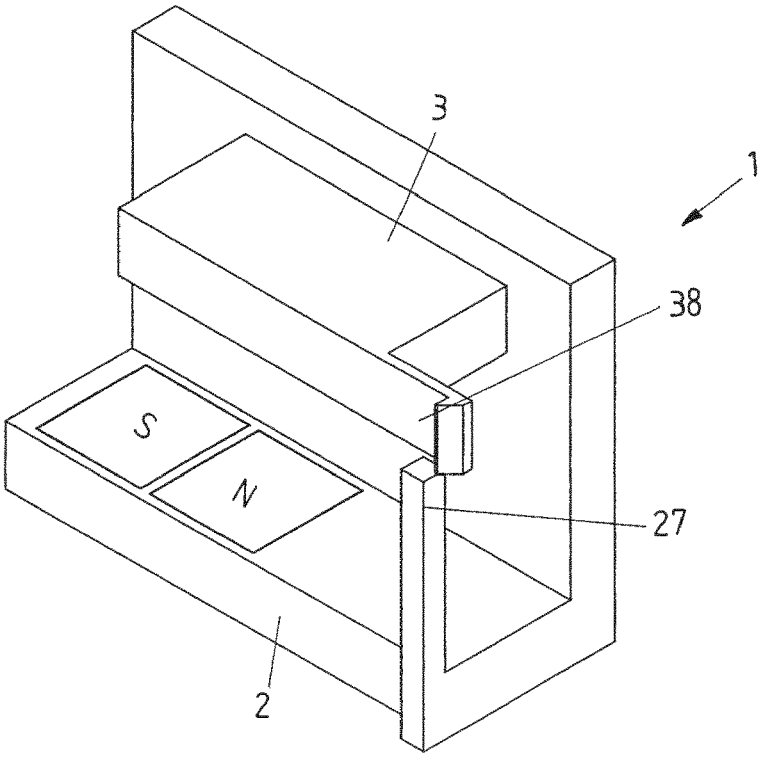
Figure 12D:
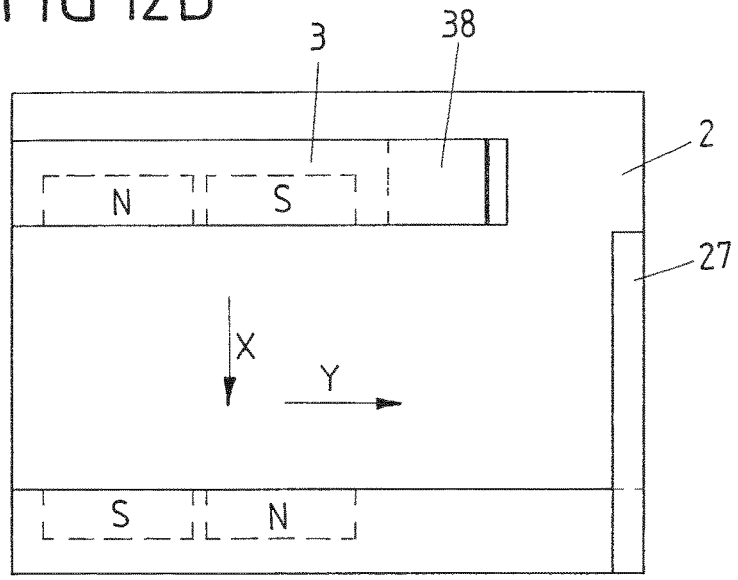
Figure 13D:
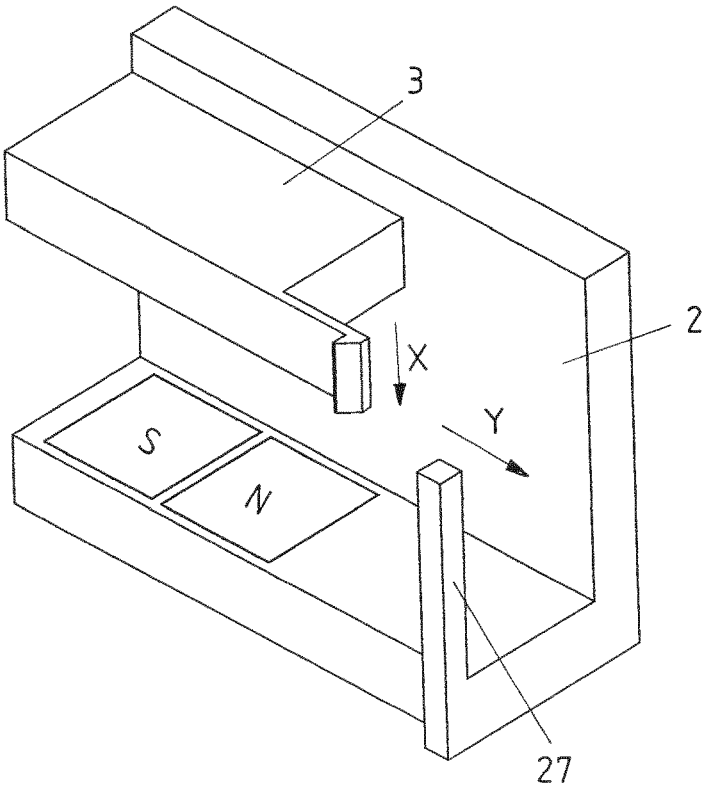

FIGS. 12C, 13C show the closure device 1 with separated closure parts 2, 3, wherein the snap-in guide 27 releases the latching hook 38 after a separating movement by a distance H corresponding to the height of the snap-in guide 27 and the second closure part 3 thus can be set back into the starting position according to FIGS. 12D, 13D against the opening direction Y. This return movement can be effected due to the magnetic forces acting between the magnets 22, 23, 314, 315. It is also conceivable to provide additional means for example in the form of a mechanical spring which is tensioned on opening of the closure device 1.

The idea underlying the invention is not limited to the exemplary embodiments set forth above, but can also be realized in completely different embodiments.

A closure device as described above advantageously can be used as closure for furniture. In particular, the closure device can serve as closure for furniture doors, drawers, sliding doors or the like.

A closure device as described above can, however, also be used as closure for a bag, as closure for a safety belt or for any other closures, in which two parts are to be connected with each other in a safe and loadable manner and in which opening should be possible in an easy, haptically pleasant way.

LIST OF REFERENCE NUMERALS

1 closure device
2 closure part (female part)
20 housing
200 receiving opening
201 cutout
21 detent spring element
210, 211 detent spring arms
212, 213 receiving opening
22, 23 magnet
24 pin
25 connecting link guideway
250, 251,
252, 254 portion
253 abutment portion
255 entry point
26 opening
27 snap-in guide
3 closure part (male part)
30 actuating element
300 guiding device
301 guideway
302 webs
303 opening
304 thread web
305 pretensioning spring
31 guiding part
310 web
311 plug
312, 313 latching protrusion
314, 315 magnet
316 thread groove
32 connecting link guideway
320 first connecting link portion
321 second connecting link portion
322 abutment portion
33 holding part
331, 332 receiving opening
34 actuating part
340 pin
341 cutout
35 bolt
36 pin
37 stem
38 latching hook
4 actuating element
40 slide
B actuating direction
H path
S oblique guiding direction
V1-V4 direction of movement
X closing direction
Y opening direction

The invention claimed is:

1. A closure device for connecting two parts, comprising:

a first closure part, a second closure part, which for closing the closure device is attachable to the first closure part in a closing direction, is held at the first closure part in a closed position, for opening the closure device is movable relative to the first closure part in an opening direction different from the closing direction, and after opening of the closure device is removable from the first closure part against the closing direction for separating the first closure part and the second closure part, magnetic means, which act between the first closure part and the second closure part, in order to support closing of the closure device by providing a force of magnetic attraction, and blocking means which are formed to block a return movement of the second closure part against the opening direction relative to the first closure part on separation of the first closure part and the second closure part, wherein the blocking means are formed by a connecting link guideway for at least sectionally guiding the second closure part on opening of the closure device and/or on separation of the first closure part and the second closure part, and wherein the connecting link guideway includes at least one abutment portion which on separation of the first closure part and the second closure part blocks a return movement of the second closure part against the opening direction relative to the first closure part, wherein the second closure part is connected with an actuating element and guided on the actuating element such that for opening the closure device, the actuating element is to be moved relative to the second closure part in an actuating direction different from the opening direction, and the movement of the actuating element is converted into a movement of the second closure part in the opening direction, and wherein for opening the closure device, the actuating element is to be moved in the or against the closing direction relative to the second closure part.

2. The closure device according to claim 1, wherein on opening the force of magnetic attraction at least is attenuated.

3. The closure device according to claim 1, wherein after the second closure part has been moved in the opening direction relative to the first closure part, the magnetic means have a magnetically repelling effect.

4. The closure device according to claim 1, wherein means are provided which magnetically or by a spring mechanism support the separation of the first closure part and the second closure part after opening of the closure device.

5. The closure device according to claim 1, wherein means are provided, which effect a return movement of the first closure part and the second closure part against the opening direction into a position in which the second closure part can be attached to the first closure part in the closing direction for closing the closure device, after the second closure part has been moved against the closing direction relative to the first closure part along a predetermined path for separating the first closure part and the second closure part.

6. The closure device according to claim 1, wherein in the closed position the first closure part and the second closure part are mechanically latched with each other such that the second closure part is not movable against the closing direction from the closed position relative to the first closure part.

7. The closure device according to claim 1, wherein one of the first closure part and the second closure part includes a detent spring element and the other of the first closure part and the second closure part includes at least one latching protrusion, and wherein in the closed position the detent spring element and the at least one latching protrusion latchingly are in engagement with each other.

8. The closure device according to claim 1, wherein the second closure part is forcibly guided on the actuating element via a guiding device such that during a movement of the actuating element in the actuating direction the second closure part is moved in the opening direction relative to the first closure part.

9. The closure device according to claim 8, wherein the guiding device is formed as a threaded guide with at least one thread groove.

10. A closure device for connecting two parts, comprising:

a first closure part, a second closure part, which for closing the closure device is attachable to the first closure part in a closing direction, is held at the first closure part in a closed position, for opening the closure device is movable relative to the first closure part in an opening direction different from the closing direction, and after opening of the closure device is removable from the first closure part against the closing direction for separating the first closure part and the second closure part, magnetic means, which act between the first closure part and the second closure part, in order to support closing of the closure device by providing a force of magnetic attraction, and blocking means which are formed to block a return movement of the second closure part against the opening direction relative to the first closure part on separation of the first closure part and the second closure part, wherein the blocking means are formed by a connecting link guideway for at least sectionally guiding the second closure part on opening of the closure device and/or on separation of the first closure part and the second closure part, and wherein the connecting link guideway includes at least one abutment portion which on separation of the first closure part and the second closure part blocks a return movement of the second closure part against the opening direction relative to the first closure part, and wherein the connecting link guideway includes a first connecting link portion for guiding the second closure part relative to the first closure part in the closing direction on closing and a second connecting link guide portion for guiding the second closure part relative to the first closure part in the opening direction on opening.

11. The closure device according to claim 10, wherein the connecting link guideway includes a third connecting link portion for guiding the second closure part relative to the first closure part against the closing direction on separation after opening of the closure device.

12. A closure device for connecting two parts, comprising:

a first closure part, a second closure part, which for closing the closure device is attachable to the first closure part in a closing direction, is held at the first closure part in a closed position, for opening the closure device is movable relative to the first closure part in an opening direction different from the closing direction, and after opening of the closure device is removable from the first closure part against the closing direction for separating the first closure part and the second closure part, magnetic means, which act between the first closure part and the second closure part, in order to support closing of the closure device by providing a force of magnetic attraction, and blocking means which are formed to block a return movement of the second closure part against the opening direction relative to the first closure part on separation of the first closure part and the second closure part, wherein the blocking means are formed by a connecting link guideway for at least sectionally guiding the second closure part on opening of the closure device and/or on separation of the first closure part and the second closure part, and wherein the connecting link guideway includes at least one abutment portion which on separation of the first closure part and the second closure part blocks a return movement of the second closure part against the opening direction relative to the first closure part, wherein the second closure part is connected with an actuating element and guided on the actuating element such that for opening the closure device, the actuating element is to be moved relative to the second closure part in an actuating direction different from the opening direction, and the movement of the actuating element is converted into a movement of the second closure part in the opening direction, and wherein damping means are formed and provided between the actuating element and the second closure part, in order to attenuate a power transmission from the actuating element to the second closure part during a movement of the actuating element in the actuating direction.

13. A furniture element comprising a closure device according to claim 1.

* * * * *